US011485104B2

(12) United States Patent
Ruhland et al.

(10) Patent No.: US 11,485,104 B2
(45) Date of Patent: Nov. 1, 2022

(54) MATERIAL ROLL PREPARATION ARRANGEMENT

(71) Applicant: BHS Intralogistics GmbH, Mintraching (DE)

(72) Inventors: Karl Ruhland, Pfreimd (DE); Martin Ruhland, Regensburg-Sallern-Gallingkofen (DE); Thomas Huber, Regensburg (DE); Tobias Hofmann, Schwarzenbach am Wald (DE)

(73) Assignee: BHS Intralogistics GmbH, Mintraching (DE)

( * ) Notice: Subject to any disclaimer, the term of this patent is extended or adjusted under 35 U.S.C. 154(b) by 357 days.

(21) Appl. No.: 16/783,437

(22) Filed: Feb. 6, 2020

(65) Prior Publication Data

US 2020/0254711 A1 Aug. 13, 2020

(30) Foreign Application Priority Data

Feb. 7, 2019 (DE) ..... 10 2019 201 601.4

(51) Int. Cl.

| | |
|---|---|
| ***B31F 1/28*** | (2006.01) |
| ***B65B 69/00*** | (2006.01) |
| ***B65H 19/10*** | (2006.01) |
| ***B31F 1/20*** | (2006.01) |

(52) U.S. Cl.

CPC ..... *B31F 1/2863* (2013.01); *B31F 1/20* (2013.01); *B65B 69/0025* (2013.01); *B65B 69/0033* (2013.01); *B65H 19/102* (2013.01); *B65H 19/105* (2013.01); *B65H 2301/41508* (2013.01)

(58) Field of Classification Search

None

See application file for complete search history.

(56) References Cited

U.S. PATENT DOCUMENTS

| | | | | |
|---|---|---|---|---|
| 4,543,152 | A * | 9/1985 | Nozaka | B65H 19/1852 242/555.6 |
| 4,588,344 | A * | 5/1986 | Burke | B65H 19/123 242/562 |
| 5,016,429 | A | 5/1991 | Kubsik et al. | |
| 5,060,456 | A | 10/1991 | Wehrli | |
| 5,799,577 | A | 9/1998 | Takahashi | |
| 2003/0015296 | A1 | 2/2003 | Pelagatti et al. | |
| 2006/0076449 | A1 | 4/2006 | Stitz et al. | |
| 2015/0121985 | A1* | 5/2015 | Nunota | B65H 16/106 219/121.72 |

(Continued)

FOREIGN PATENT DOCUMENTS

| | | | |
|---|---|---|---|
| CN | 206665106 | U | 11/2017 |
| DE | 10205462 | C1 | 9/2003 |

(Continued)

*Primary Examiner* — Barbara J Musser

(74) *Attorney, Agent, or Firm* — McGlew & Tuttle, P.C.

(57) ABSTRACT

The invention relates to a material roll preparation arrangement. The material roll preparation arrangement comprises a receiving apparatus for receiving a material roll to be prepared with a wound material web, and at least one material roll preparation apparatus which is assigned to the receiving apparatus for the preparation of the material roll which is received in the receiving apparatus for further processing, in particular in a corrugator plant.

25 Claims, 15 Drawing Sheets

(56) References Cited

U.S. PATENT DOCUMENTS

| | | | | |
|---|---|---|---|---|
| 2015/0360436 | A1* | 12/2015 | Ohira | B31F 1/2818 156/354 |
| 2017/0036875 | A1* | 2/2017 | Mathy, Jr. | B29C 66/8324 |
| 2018/0079614 | A1* | 3/2018 | Pasquale | B65H 19/1821 |
| 2018/0257403 | A1 | 9/2018 | Yasuda | |
| 2019/0092596 | A1* | 3/2019 | Tsujimoto | B26D 1/04 |
| 2019/0300220 | A1* | 10/2019 | Englund | B65B 69/0025 |

FOREIGN PATENT DOCUMENTS

| | | | | |
|---|---|---|---|---|
| DE | 10 2012 211 708 | A1 | 1/2014 | |
| DE | 10 2013 226 022 | A1 | 6/2015 | |
| DE | 102016206711 | A1 | 10/2017 | |
| DE | 102018113490 | A1 | 12/2019 | |
| EP | 0820946 | A1 | 1/1998 | |
| EP | 1518808 | A1 | 3/2005 | |
| EP | 1645534 | A1 | 4/2006 | |
| EP | 1688379 | A2 | 8/2006 | |
| EP | 3309096 | A1 | 4/2018 | |
| EP | 3578472 | A2 | 12/2019 | |
| KR | 100985461 | B1 | 10/2010 | |
| WO | 2016/173853 | A1 | 11/2016 | |
| WO | WO-2017183553 | A1 * | 10/2017 | B26D 1/04 |
| WO | 2018013030 | A1 | 1/2018 | |

* cited by examiner

MATERIAL ROLL PREPARATION ARRANGEMENT

CROSS-REFERENCES TO RELATED APPLICATIONS

This application claims the priority of German Patent Application, Serial No. DE 10 2019 201 601.4, filed Feb. 7, 2019, pursuant to 35 U.S.C. 119(a)-(d), the content of which is incorporated herein by reference in its entirety as if fully set forth herein.

FIELD OF THE INVENTION

The invention relates to a material roll preparation arrangement for the preparation of a material roll for further processing, in particular in a corrugator. Moreover, the invention is directed to an overall system having a material roll preparation arrangement of this type. Moreover, the invention is directed to a method for the preparation of a material roll for further processing, in particular in a corrugator.

BACKGROUND OF THE INVENTION

The production of paper and (corrugated) cardboard or the like is associated with not inconsiderable costs.

SUMMARY OF THE INVENTION

The invention is based on an object of providing a material roll preparation arrangement which is capable of reducing the manufacturing costs for the production of paper, (corrugated) cardboard or the like or webs of the said materials. Furthermore, a material roll which is prepared in this way is to be capable of further processing in a particularly functionally reliable manner. A corresponding overall system and a corresponding method are to be provided, moreover.

According to the invention, this object is achieved by a material roll preparation arrangement, comprising a receiving apparatus for receiving a material roll to be prepared with a wound material web, and at least one material roll preparation apparatus which is assigned to the receiving apparatus for preparation of the material roll which is received in the receiving apparatus for further processing, in particular in a corrugator plant.

This object is further achieved by an overall system, comprising a material roll preparation arrangement according to the invention and a corrugator plant.

This object is further achieved by a method for preparation of a material roll, comprising the following steps:

- receiving of a material roll to be prepared with a wound material web by means of a receiving apparatus, and
- preparing of the material roll which is received in the receiving apparatus by means of at least one material roll preparation apparatus which is assigned to the receiving apparatus for further processing, in particular in a corrugator plant.

The core concept of the invention lies in at least one material roll preparation apparatus which is capable of preparing a material roll for further processing in an efficient and functionally reliable manner.

The preparation of the material roll comprises, for example, the unpacking or exposing thereof, the removal or destruction of at least one fixing means which fixes a free material web section in order to prevent unwinding, the removal of at least one strapping element, the removal of a damaged material web section from the material roll, the production of a defined final contour or edge for further processing on the material web, the attachment of at least one adhesive piece, such as splicing tape, to the material web and/or the fixing of an end-side material web section.

It is expedient if there are a plurality of material roll preparation apparatuses which preferably differ in terms of the preparation which they carry out. During the preparation, an action is preferably carried out on the material web during at least one step. During at least one other step, the material web preferably remains uninfluenced. In particular, the material roll is prepared in the material web preparation arrangement for use in a splicing apparatus.

The material roll is preferably held securely and can be prepared in the receiving apparatus.

It is expedient if the overall system comprises only precisely one material roll preparation arrangement. This is extremely advantageous in economic terms. As an alternative, there are a plurality of material roll preparation arrangements.

The receiving apparatus comprising a rotational device for rotationally driving the received material roll about its centre axis permits a particularly satisfactory and simple preparation of the material roll. In particular, the material roll can be pivoted about its centre axis or can be driven rotationally by means of the rotational device. The material roll can thus be pivoted, for example, with respect to the at least one material roll preparation apparatus, in order that the said material roll preparation apparatus is capable of beginning its work. As an alternative, the material roll is pivoted or rotated by means of the rotational device, for example, during its preparation. The rotational device preferably comprises at least one rotary drive which is drive-connected directly or indirectly to the material roll.

The spaced apart arrangement of the material roll with respect to a floor, such as a factory floor, in which the receiving apparatus holds the material roll to be prepared such that it is spaced apart from a floor and, in particular, is arranged horizontally, ensures a particularly satisfactory manageability and (in particular, complete) accessibility of the material roll during the preparation. Furthermore, the material roll then already assumes, for example, a position which it also assumes later during its further processing. The material roll then extends horizontally. As an alternative, the material roll is arranged upright, for example, in the receiving apparatus.

The refinement comprising an aligning device for aligning a receiving device of the receiving apparatus and the material roll which is received in the receiving apparatus with respect to one another prevents, in particular, damage of the material roll during its preparation. Moreover, the preparation can thus be carried out in a particularly functionally reliable and high quality manner. The aligning device is capable, for example, of bringing about an axial displacement along the material roll between the receiving device and the material roll. As an alternative or in addition, the aligning device is capable of reducing or cancelling an oblique position between the receiving device and the received material roll. The receiving device comprises, for example, at least one holding mandrel which engages into the material roll or into its central carrying core. There are favourably two holding mandrels which lie opposite one another and engage into the material roll or its carrying core. Furthermore, the receiving device preferably has at least one movable aligning unit which preferably acts directly or indirectly on at least one holding mandrel.

The receiving apparatus being configured to receive the material roll to be prepared, in an, in particular completely, automated manner is capable of receiving the material roll to be prepared in a manner which is (in particular, completely) automated, automatic or autonomous. Here, workers are superfluous. Man hours are not incurred, in particular. A receiving apparatus of this type is particularly economical and functionally reliable.

The material roll preparation apparatu, in which at least one material roll preparation apparatus is capable of operating in an, in particular completely, automated manner, is also particularly economical and functionally reliable. Workers are superfluous for the preparation. Man hours are not incurred. It is expedient if, in the case of a plurality of material roll preparation apparatuses, at least one, preferably at least a few, preferably all, of the material roll preparation apparatuses operates/operate in a manner which is (in particular, completely) automated or automatic.

The material roll detection apparatus for detection of a material web section of the material web of the material roll which is received in the receiving apparatus is configured, for example, as a camera, a sensor or the like. It is capable, for example, of checking a state of the detected (in particular, unwound) material web section. The material roll detection apparatus preferably operates in a contactless manner.

The material roll preparation apparatus being configured as a strapping element removal apparatus for removal of at least one strapping element which straps the material roll is capable of freeing the material roll, in particular in an automated manner, from the at least one strapping element which is usually used as a transport securing means and is preferably configured as a strapping band. The at least one strapping element preferably runs around the material roll on the circumferential side and forms a ring. It is, for example, flexible and is formed from plastic, metal or the like. It is expedient if the material roll is originally strapped by a plurality of strapping elements which are spaced apart axially.

The strapping element detection device, comprised by the strapping element removal apparatus, for detection of the at least one strapping element operates, for example, in a contactless manner. It is preferably configured as a camera, a sensor or the like. The at least one strapping element can be detected, for example, by way of a contour measurement of the material roll and/or scanning of its surface. In particular, its location or position can be detected.

The strapping element cutting unit, comprised by the strapping element removal apparatus, for cutting the at least one strapping element is formed, for example, by way of a cutting-edge, a blade or the like. As an alternative, it operates in a contactless manner, for example by way of a laser. It is expedient if the strapping element cutting unit is signal-connected to the strapping element detection device, in order that the strapping element cutting unit can be moved to the detected strapping element.

The material roll preparation apparatus being configured as a side cover removal apparatus for removal of side covers which cover the material roll on end side is capable of removing (in particular, in an automated manner) side covers which cover the material roll on the end side or on the front side. The side covers are configured, for example, as circular blanks. The side covers are also usually used for transport protection of the material roll. The side covers are formed, for example, from a plastic material.

The side cover severing blade unit having a side cover severing blade unit for removal of the side covers, in particular in case of a rotating material roll, is preferably capable of removing (in particular, in an automated manner) the side covers without damage of the actual material roll. It is advantageous if the material roll rotates about its centre axis during the removal of the side covers.

The material roll preparation apparatus being configured as a protective plug removal apparatus for removal of protective plugs which are arranged in a central carrying core of the material roll on end side is capable of removing (in particular, in an automated manner) protective plugs which are situated in the central carrying core and serve for the transport protection of the material roll. The protective plugs preferably have a circular or circularly annular cross section.

The material roll preparation apparatus being configured as a peeling apparatus for removal of an end-side material web section of the material roll is suitable for peeling or for removing (in particular, in an automated manner) an end-side or edge-side material web section of the material roll. An end-side or outer material web section is usually affected during the transport of the material roll, and has damage, such as scratches, tears, dents or the like, with the result that it is unusable.

The lifting device, comprised by the peeling apparatus, for lifting the end-side material web section of the material web from a material web section which is arranged below it on the material roll preferably has a suction or vacuum unit and/or at least one lifting mandrel, in order to lift the end-side material web section in regions.

The discharging transport device, comprised by the peeling apparatus, for discharge of the lifted material web section comprises, for example, at least one discharging roll, at least one transport belt, a chute or the like.

The quality testing device, comprised by the peeling apparatus, having a quality testing device which is assigned to the discharging transport device for quality testing of the discharged material web section is capable of testing the quality of the discharged material web section. In particular, the quality testing device is capable of detecting damage to the (in particular, unwound) material web section. It is expedient if the quality testing device comprises a peeling computing unit which is, in particular, electric or electronic.

The refinement, in which a peeling computing device activates the peeling severing device if the quality testing device detects an undamaged material web section, is particularly economical. In particular, it is thus avoidable that too much material web is removed from the material roll.

The material roll preparation apparatus being configured as a final contour production apparatus for the production of a final contour in the material web, which final contour is usable as in the further processing, is capable of producing a final contour in the material web over its width, in particular in an automated manner. It ensures a particularly functionally reliable, fault-free further use of the material roll. The final contour is delimited or formed, for example, by way of at least one end edge which runs in a straight and/or curved manner at least in regions.

The final contour production apparatus having a final contour cutting device or final contour punching device is configured as a final contour cutting device or a final contour punching device. A final contour production apparatus of this type is extremely functionally reliable and economical. It can be separate or can be a constituent part of a material roll preparation apparatus.

The material roll preparation apparatus being configured as a splicing piece attachment apparatus for the attachment of at least one splicing piece onto the material web for the splicing of another material web is preferably configured as a splicing tape which is preferably adhesive on both sides. It is expedient if the splicing piece attachment apparatus attaches (in particular, in an automated manner) the at least one splicing piece adjacently with respect to a free end or with respect to a produced final contour on the free material web section. The prepared material roll can preferably be used in the splicing apparatus without further processing.

It is advantageous if the splicing piece attachment apparatus has a splicing piece supply device and preferably a splicing piece pressing device for pressing the splicing piece onto the material roll or onto its free material web section. It is advantageous if the splicing piece attachment apparatus comprises an actuable severing device for severing the splicing piece.

The material roll preparation apparatus being configured as a material web fixing apparatus for fixing an end-side material web section makes reliable transport of the prepared material roll possible. It can thus be avoided, in particular, that the material web unwinds unintentionally. The material web fixing apparatus is configured, for example, as an adhesive apparatus or adhesive piece attachment apparatus. It is preferably capable of attaching (in particular, in an automated manner) at least one adhesive piece to the free material web section and a material web section which is arranged below it and is adjacent on the material roll. To this end, the at least one adhesive piece preferably protrudes beyond a free end of the free material web section.

It is advantageous if the adhesive piece attachment apparatus has an adhesive piece supply device and preferably an adhesive piece pressing device for pressing the adhesive piece onto the free material web section and the adjoining material web section which is arranged below it. It is advantageous if the adhesive piece attachment apparatus comprises an actuable severing device for severing the adhesive piece.

The material roll preparation arrangement comprises a plurality of material roll preparation apparatuses which are formed by way of at least one robot. A material roll preparation arrangement of this type is particularly economical. It is expedient if a plurality of the material roll preparation apparatuses, preferably all of the material roll preparation apparatuses, are formed by way of at least one robot, preferably precisely one robot. The robot is preferably configured as an articulated arm and/or gantry robot. It preferably has a working arm with at least one tool holder. The robot is preferably multifunctional. It is expedient if the strapping element removal apparatus, the side cover removal apparatus, the protective plug removal apparatus, the lifting device of the peeling apparatus, the splicing piece attachment apparatus, the adhesive piece attachment apparatus and/or the material web fixing apparatus uses/use the robot or is/are formed by way of the said robot.

As an alternative, a plurality of material roll preparation apparatuses, preferably all of the material roll preparation apparatuses, are configured separately and independently of one another.

The robot uses interchangeable tools. It is advantageous if each interchangeable tool has a coupling piece which allows coupling of the interchangeable tool to a tool holder of the robot. It is expedient if each interchangeable tool can be connected fixedly to the robot. The robot is preferably capable of receiving the respective interchangeable tool automatically or on its own.

The refinements according to the invention also relate to preferred further developments of the method according to the invention. Individual aspects of the disclosed subjects can also be a constituent part of an independent invention.

In the following text, one preferred embodiment of the invention will be described by way of example with reference to the appended drawing.

DESCRIPTION OF THE PREFERRED EMBODIMENT

Figure 1:
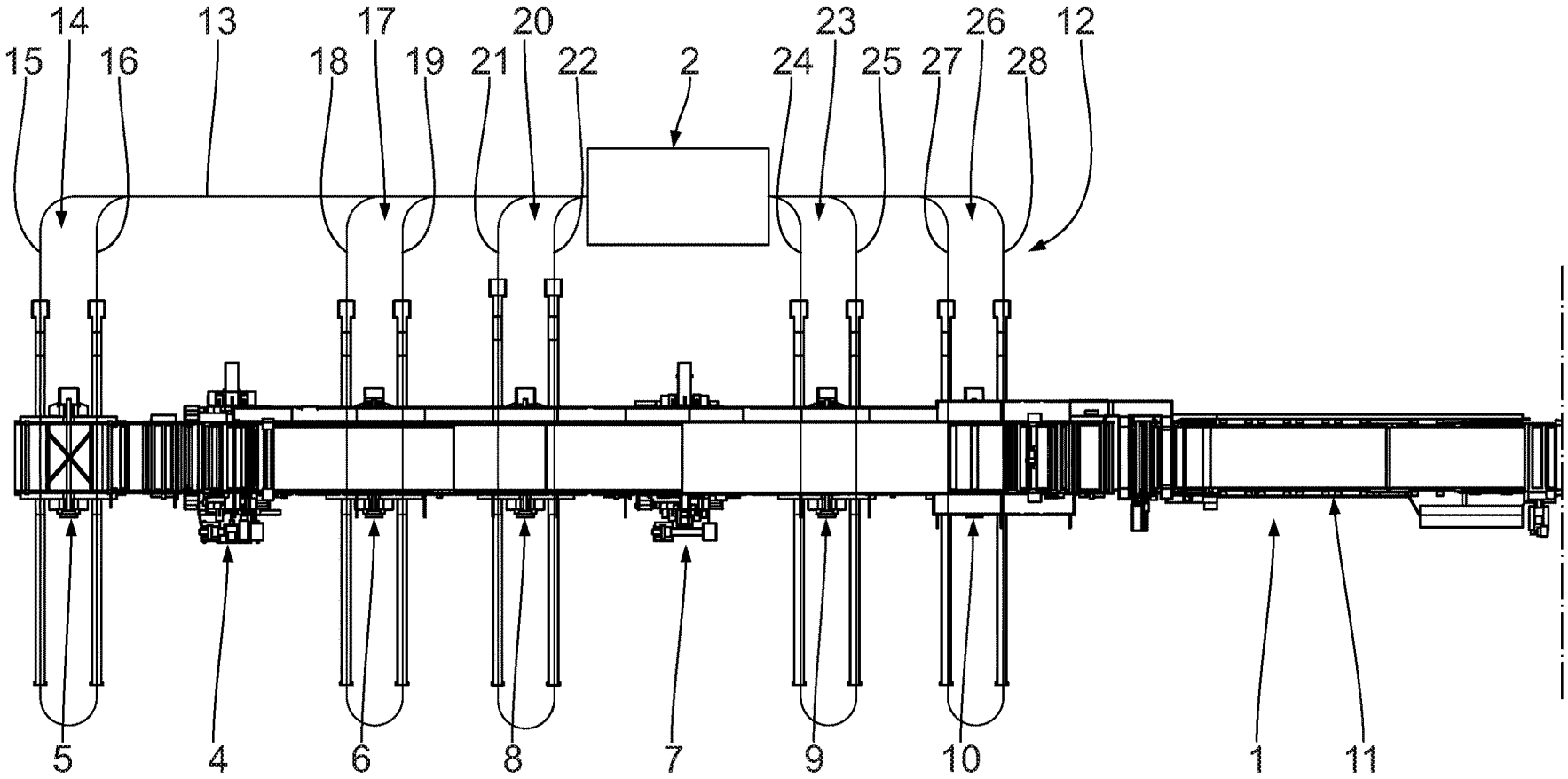
FIG. 1 shows a plan view of a simplified overall system according to the invention.

An overall system which is shown in its entirety in FIG. 1 comprises a corrugator plant 1 and precisely one material roll preparation arrangement 2 which is arranged adjacently with respect to the said corrugator plant 1, for the preparation of material rolls 3 for use in the corrugator plant 1.

The corrugator plant 1 extends rectilinearly. It has a first corrugated cardboard production apparatus 4 for the production of a first corrugated cardboard web which is laminated on one side. A first top web splicing apparatus 5 and a first intermediate web splicing apparatus 6 are arranged upstream of the first corrugated cardboard production apparatus 4. The first top web splicing apparatus 5 comprises a first unrolling unit for unrolling a finite first top web from a first top web roll, and a second unrolling unit for unrolling a finite second top web from a second top web roll. The finite first top web and second top web are connected to one another by means of a connecting and cutting unit of the first top web splicing apparatus 5 for the provision of an endless first top web.

The first intermediate web splicing apparatus 6 is configured in accordance with the first top web splicing apparatus 5. The said first intermediate web splicing apparatus 6 comprises a third unrolling unit for unrolling a finite first intermediate web from a first intermediate web roll, and a fourth unrolling unit for unrolling a finite second intermediate web from a second intermediate web roll. The finite first intermediate web and second intermediate web are connected to one another by means of a connecting and cutting unit of the first intermediate web splicing apparatus 6 for the provision of an endless first intermediate web.

The endless first top web and the endless first intermediate web are fed to the first corrugated cardboard production apparatus 4.

For the production of an endless first corrugated cardboard web which has a corrugation from the endless first intermediate web, the first corrugated cardboard production apparatus 4 comprises a first corrugated roll arrangement with a first corrugated roll and a second corrugated roll. The corrugated rolls configure a first roll nip for guiding through and corrugating the endless first intermediate web.

For the connection of the endless first top web with the endless corrugated first intermediate web or the corrugated web to the endless first corrugated cardboard web which is laminated on one side, the first corrugated cardboard production apparatus 4 has a first glue application device which preferably comprises a glue metering roll, a glue container and a glue application roll. The glue application roll configures a nip with the first corrugated roll in order to guide through and glue the endless first corrugated web. The glue which is situated in the glue container is applied via the glue application roll to peaks of the corrugation of the endless first corrugated web. The glue metering roll bears against the glue application roll and serves to configure a homogeneous glue layer on the glue application roll.

The endless first top web is subsequently joined together with the endless first corrugated web which is provided with the glue from the glue container in the first corrugated cardboard production apparatus 4 for the production of the first corrugated cardboard web which is laminated on one side.

In order to press the endless first top web against the endless first corrugated web which is provided with glue and in turn bears in regions against the first corrugated roll, the first corrugated cardboard production apparatus 4 has a first pressing module. The first pressing module is favourably configured as a pressing belt module. It is arranged above the first corrugated roll. The first pressing module has two first deflection rolls and an endless first pressing belt which is guided around the two first deflection rolls.

The first corrugated roll engages from below in regions into a space between the two deflection rolls of the first pressing module, as a result of which the first pressing belt is deflected by way of the first corrugated roll. The first pressing belt presses against the endless first top web which in turn is pressed against the endless first corrugated cardboard web which is provided with glue and bears against the first corrugated roll.

In order to temporarily store and buffer the endless first corrugated cardboard web which is laminated on one side, the latter is fed via a first upper transport device to a first storage apparatus, where it forms loops.

Furthermore, the corrugated cardboard system 1 has a second corrugated cardboard production apparatus 7 which is configured in accordance with the first corrugated cardboard production apparatus 4.

A second top web splicing apparatus 8 and a second intermediate web splicing apparatus 9 which are configured in accordance with the first top web splicing apparatus 5 and the first intermediate web splicing apparatus 6, respectively, are arranged upstream of the second corrugated cardboard production apparatus 7.

The second top web splicing apparatus 8 comprises a fifth unrolling unit for unrolling a finite third top web from a third top web roll, and a sixth unrolling unit for unrolling a finite fourth top web from a fourth top web roll. The finite third top web and fourth top web are connected to one another by means of a connecting and cutting unit of the second top web splicing apparatus 8 in order to provide an endless second top web.

The second intermediate web splicing apparatus 9 comprises a seventh unrolling unit for unrolling a finite third intermediate web from a third intermediate web roll, and an eighth unrolling unit for unrolling a finite fourth intermediate web from a fourth intermediate web roll. The finite third intermediate web and fourth intermediate web are connected to one another by means of a connecting and cutting unit of the second intermediate web splicing apparatus 9 in order to provide an endless second intermediate web.

The second corrugated cardboard production apparatus 7 is capable of producing an endless second corrugated cardboard web which is laminated on one side from the endless second top web and intermediate web.

The second corrugated cardboard web which is laminated on one side is fed to a second storage apparatus, where it forms loops.

Moreover, the corrugated cardboard system 1 has a laminating web splicing apparatus 10 which comprises a ninth unrolling unit for unrolling a finite first laminating web from a first laminating web roll, and a tenth unrolling unit for unrolling a finite second laminating web from a second laminating web roll. The finite first laminating web and the finite second laminating web are connected to one another by means of a connecting and cutting unit of the laminating web splicing apparatus 10 in order to provide an endless laminating web.

Downstream with respect to the storage apparatuses and the laminating web splicing apparatus 10, the corrugated cardboard system 1 has a preheating apparatus (not shown) which comprises three preheating rolls which are arranged above one another. The endless corrugated cardboard webs which are laminated on one side and the endless laminating web are fed to the preheating rolls.

Downstream with respect to the preheating apparatus, the corrugated cardboard system 1 has a gluing unit (not shown) with gluing rolls which dip partially into a respective glue bath. A glue metering roll bears against each gluing roll, in order to configure a homogeneous glue layer on the adjacent gluing roll. The first corrugated cardboard web which is laminated on one side is situated by way of its corrugated web in contact with a first gluing roll, with the result that the corrugation of the said corrugated web is provided with glue from the glue bath. The second corrugated cardboard web which is laminated on one side is situated by way of its corrugated web in contact with a second gluing roll, with the result that the corrugation of the said corrugated web is provided with glue from the associated glue bath.

Downstream with respect to the gluing unit, the corrugated cardboard system 1 has a connecting apparatus 11 which is configured as a heating/pressing apparatus and comprises a horizontally running heating table. An endless pressing strap which is guided around guide rolls is arranged adjacently with respect to the heating table. A pressing nip is configured between the pressing strap and the heating table, through which pressing the corrugated cardboard webs which are laminated on one side and the endless laminating web are guided with the formation of an endless (here, five-layer) corrugated cardboard web.

Downstream with respect to the connecting apparatus 11, the corrugated cardboard system 1 has a short cross-cutting apparatus (not shown).

Downstream with respect to the short cross-cutting apparatus, the corrugated cardboard system 1 has a slitting/scoring apparatus (not shown).

Downstream with respect to the slitting/scoring apparatus, the corrugated cardboard system 1 has a cross-cutting apparatus (not shown), in order to produce sheets from the endless corrugated cardboard web or from part webs thereof.

A conveyor belt device (not shown) is arranged downstream of the cross-cutting apparatus, in order to convey the sheets further. A delivery apparatus (not shown) is arranged downstream of the conveyor belt device, in order to form sheet stacks.

Transport carriage movement path markings 12 which indicate and stipulate the movement paths for transport carriages (not shown) in the overall system run between the material roll preparation arrangement 2 and the corrugated cardboard system 1. The transport carriage movement path markings 12 are preferably visible and are applied as a coat of paint to the flat (factory) floor which supports the corrugated cardboard system 1. They can be detected by the transport carriages. In normal operation during movement, the transport carriages follow the transport carriage movement path markings 12 which comprise bends, points and straight sections.

The material roll preparation arrangement 2 is arranged in a distribution path 13 which is preferably marked as a transport carriage movement path marking 12. The distribution path 13 extends rectilinearly and parallel to the corrugated cardboard system 1.

The distribution path 13 is adjoined by a first top web path 14. The first top web path 14 is as it were endless, and adjoins the distribution path 13 by way of a first top web path section 15 and a second top web path section 16. The top web path sections 15, 16 extend parallel to one another and are aligned with the unrolling units of the first top web splicing apparatus 5. The top web path sections 15, 16 penetrate the corrugated cardboard system 1 at a respective unrolling unit, and are connected to one another on the other side of the corrugated cardboard system 1.

The transport carriages can be moved both on the first top web path section 15 and on the second top web path section 16 in opposite directions for equipping the first top web splicing apparatus 5 and removing residual material rolls. A circulating transport of the transport carriages in one direction for equipping the first top web splicing apparatus 5 and removing residual material roll along the first top web path 14 is also possible.

The distribution path 13 is adjoined by a first intermediate web path 17 which is as it were endless, and comprises a first intermediate web path section 18 and a second intermediate web path section 19. The intermediate web path sections 18, 19 extend parallel to one another and with respect to the top web path sections 15, 16. They are aligned with the unrolling units of the first intermediate web splicing apparatus 6. The first and second intermediate web path sections 18, 19 penetrate the corrugated cardboard system 1 at the respective unrolling unit, and are connected to one another on the other side of the corrugated cardboard system 1.

The transport carriages can be moved both on the first intermediate web path section 18 and on the second intermediate web path section 19 in opposite directions for equipping the first intermediate web splicing apparatus 6 and removing residual material rolls. A circulating transport of the transport carriages in one direction for equipping the first intermediate web splicing apparatus 6 and removing a residual material roll along the first intermediate web path 17 is also possible.

The distribution path 13 is adjoined by a second top web path 20 which is as it were endless, and comprises a first top web path section 21 and a second top web path section 22. The top web path sections 21, 22 extend parallel to one another and with respect to the top web path sections 15, 16. They are aligned with the unrolling units of the second top web splicing apparatus 8. The first and second top web path sections 21, 22 penetrate the corrugated cardboard system 1 at the respective unrolling unit, and are connected to one another on the other side of the corrugated cardboard system 1.

The transport carriages can be moved both on the first top web path section 21 and on the second top web path section 22 in opposite directions for equipping the second top web splicing apparatus 8 and removing residual material rolls. A circulating transport of the transport carriages in one direction for equipping the second top web splicing apparatus 8 and removing a residual material roll along the second intermediate web section 20 is also possible.

The distribution path is adjoined by a second intermediate web path 23 which is as it were endless, and comprises a first intermediate web path section 24 and a second intermediate web path section 25. The intermediate web path sections 24, 25 extend parallel to one another and with respect to the top web path sections 15, 16. They are aligned with the unrolling units of the second intermediate web splicing apparatus 9. The first and second intermediate web path sections 24, 25 penetrate the corrugated cardboard system 1 at the respective rolling unit and are connected to one another on the other side of the corrugated cardboard system 1.

The transport carriages can be moved both on the first intermediate web path section 24 and on the second intermediate web path section 25 in opposite directions for equipping the second intermediate web splicing apparatus 9 and removing residual material rolls. A circulating transport of the transport carriages in one direction for equipping the second intermediate web splicing apparatus 9 and removing a residual material roll along the second intermediate web section 23 is also possible.

The distribution path 13 is adjoined by a laminating web path 26 which is as it were endless, and comprises a first laminating web path section 27 and a second laminating web path section 28. The laminating web path sections 27, 28 extend parallel to one another and with respect to the top web path sections 15, 16. They are aligned with the unrolling units of the laminating web splicing apparatus 10. The first and second laminating web path sections 27, 28 penetrate the corrugated cardboard system 1 at the respective unrolling unit, and are connected to one another on the other side of the corrugated cardboard system 1.

The transport carriages can be moved both on the first laminating web path section 27 and on the second laminating web path section 28 in opposite directions for equipping the laminating web splicing apparatus 10 and removing residual material rolls. A circulating transport of the transport carriages in one direction for equipping the laminating web splicing apparatus 10 and removing a residual material roll along the laminating web path 26 is also possible.

The top web paths 14, 20, the intermediate web paths 17, 23 and the laminating web path 26 are connected to the distribution path 13 in a manner which is spaced apart from one another, and also run in a manner which is spaced apart from one another. They are marked by way of the transport carriage movement path marking 12. The top web rolls, intermediate web rolls and laminating web rolls can generally also be called material rolls 3 which, viewed generally, support a corresponding, finite, wound-up material web consisting of cardboard, paper or the like.

The material roll preparation arrangement 2 receives the material rolls 3 from a material roll store (not shown). For this purpose, automated industrial trucks (not shown) are favourably used. The material roll preparation arrangement 2 is arranged at the level of and/or laterally next to the second corrugated cardboard production apparatus 7. It is arranged in the distribution path 13 between the second top web path 20 and the second intermediate web path 23.

Figure 2:
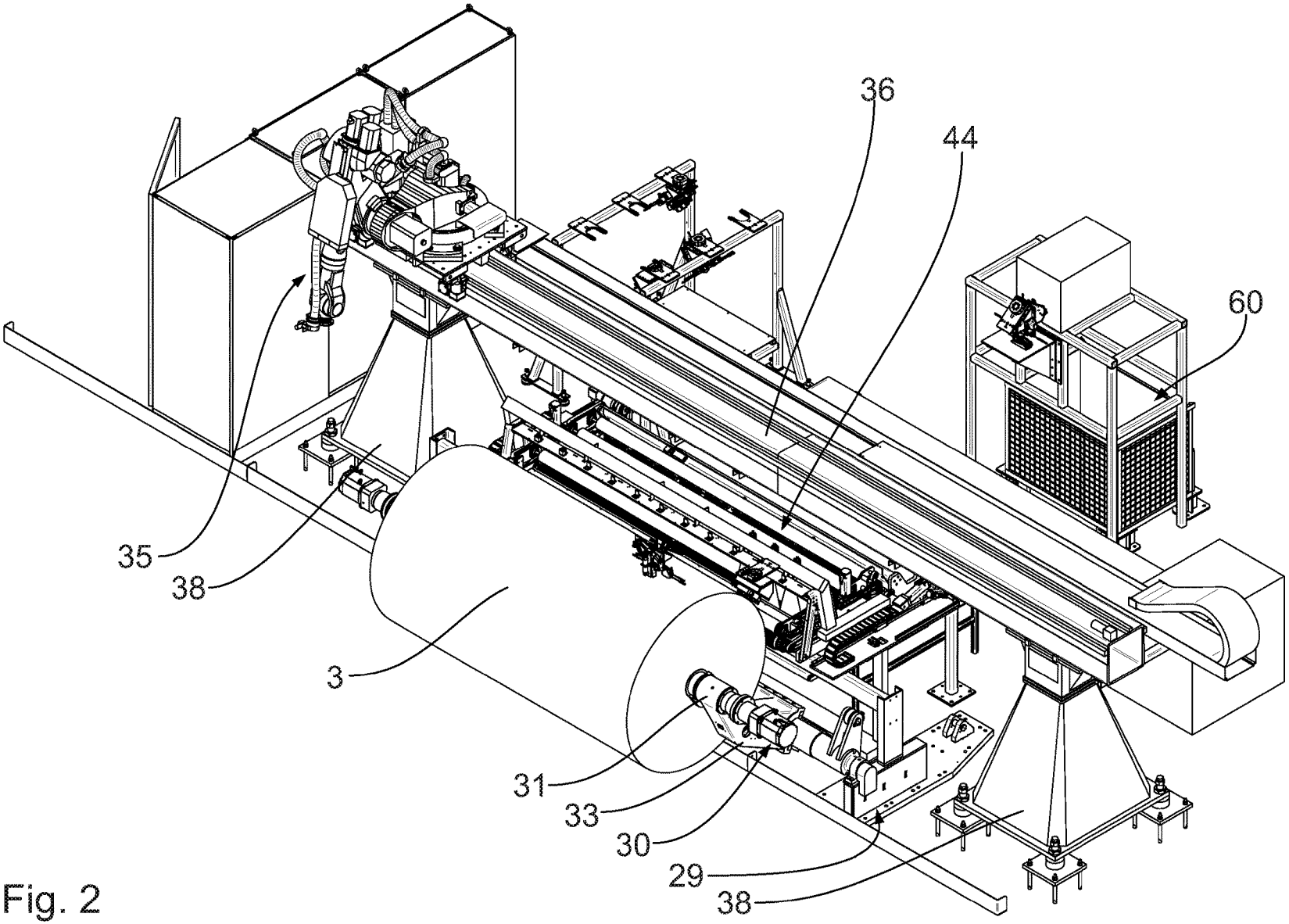
FIG. 2 shows a perspective view of a material roll preparation arrangement according to the invention of the overall system which is shown in FIG. 1.
Figure 3:
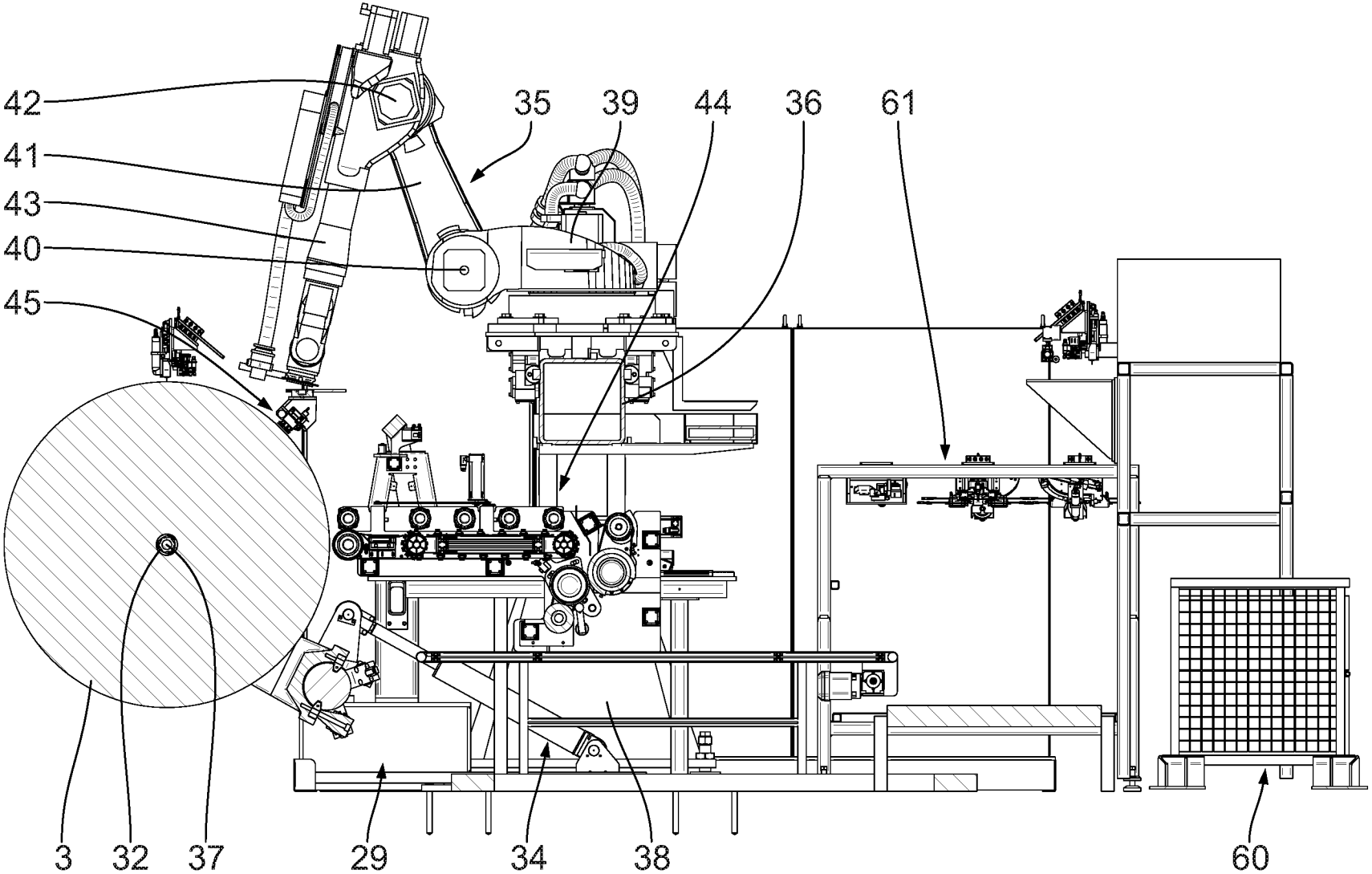
FIG. 3 shows a section through the material roll preparation arrangement which is shown in FIG. 2.

As shown in FIGS. 2 and 3, the material roll preparation arrangement 2 comprises a frame 29 which is supported with respect to the floor. The frame 29 supports a receiving apparatus 30 which comprises two holding mandrels 31 which are aligned with one another and are arranged spaced apart from one another. The holding mandrels 31 form a receiving device for a material roll 3. During use, the holding mandrels 31 engage on the end side in a manner which lies opposite one another into a central carrying core 32 of the material roll 3. The material roll 3 is mounted in this way and extends horizontally between the holding mandrels 31. It is held in a manner which is spaced apart from the floor.

Each holding mandrel 31 is held by a carrying arm 33 which can be adjusted, such as can be pivoted and/or can be displaced, by means of a variable-length adjusting unit 34. Each adjusting unit 34 is arranged pivotably on the frame 29. It is expedient if the carrying arms 33 can be adjusted independently of one another, which allows tilting of the material roll 3. The material roll 3 can be aligned in this way. The adjusting units 34 are preferably configured in each case as a piston/cylinder unit.

The material roll 3 can be driven rotationally in the receiving device.

Moreover, the material roll preparation arrangement 2 has a gantry robot 35 and a gantry carrier 36 which carries the gantry robot 35 and extends horizontally. Moreover, the gantry carrier 36 runs parallel to the receiving device and/or a centre axis 37 of the material roll 3, at least if they are aligned with respect to one another. It is supported with respect to the floor via stands 38, and is situated obliquely above the receiving device. The gantry carrier 36 makes a linear horizontal movement of the gantry robot 35 along the material roll 3 and/or in the transverse direction of the wound-up material web possible. The length of the gantry carrier 36 is longer than an axial extent of the received material roll 3, with the result that the gantry robot 35 is capable of moving along the entire material roll 3.

The gantry robot 35 is configured as a gantry/articulated arm robot. It comprises an (in particular, slide-like) base 39 which is arranged such that it can be moved on the gantry carrier 36. An intermediate arm 41 is articulated on the base 39 with the formation of a first pivot axis 40. A working arm 43 is arranged pivotably on the intermediate arm 41 on the end side with the formation of a second pivot axis 42, the length of which working arm 43 can be changed, for example, and which working arm 43 then has a linear axis. The pivot axes 40, 42 run parallel to one another and horizontally. They extend in parallel to the receiving device and/or the received material roll 3. The intermediate arm 41 and the working arm 43 form a manipulator.

The intermediate arm 41 and the working arm 43 are in each case assigned an adjusting drive, in order to adjust the intermediate arm 41 and the working arm 43 about the respective pivot axis 40 and 42, respectively, during use. Each adjusting drive favourably comprises a motor, a gear mechanism and a regulating means.

Furthermore, the gantry robot 35 has an internal sensor system which supplies information about the respective position of the manipulator.

The gantry robot 35 is favourably assigned an external sensor system, in order to give feedback about the surrounding area.

Furthermore, the gantry robot 35 has a controller. The controller monitors the movement of the manipulator and specifies its movement. The adjusting drives are controlled.

Figure 4:
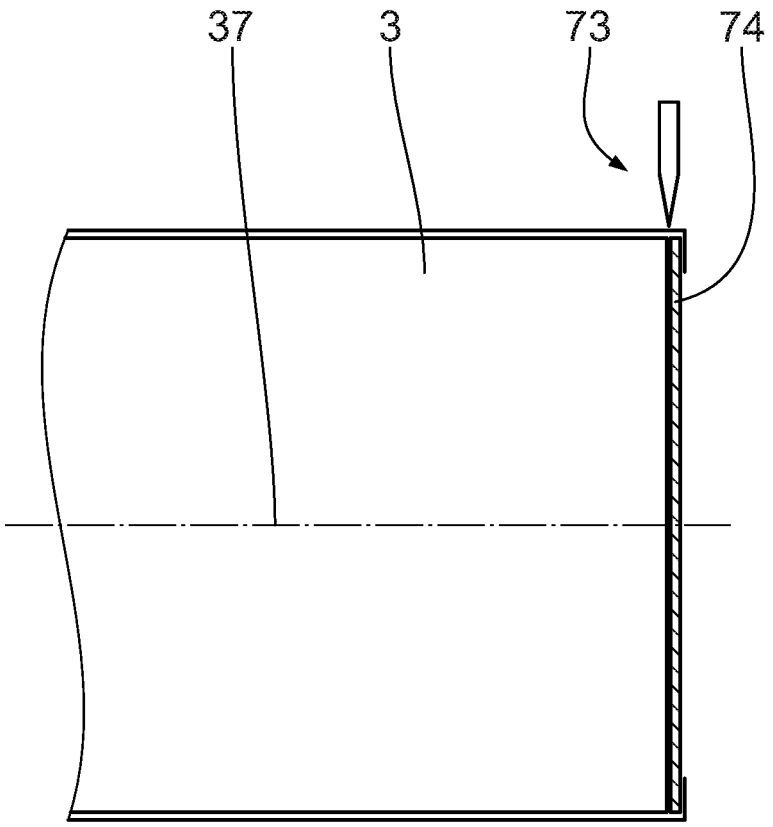
FIG. 4 shows a view of a simplified side cover removal apparatus of the material roll preparation arrangement which is shown in FIGS. 2 and 3.

The material roll preparation arrangement 2 comprises a side cover removal apparatus 73 which is capable of removing end-side side covers 74 from the material roll 3 (FIG. 4). The side covers 74 originally cover the end sides of the material rolls 3 completely. They run parallel to one another and perpendicularly with respect to the centre axis 37 of the material roll 3. The side cover removal apparatus 73 comprises a severing blade unit which can be adjusted radially in relation to the centre axis 37 of the material roll 3. During use, the severing blade unit preferably extends radially with respect to the centre axis 37 of the material roll 3. The severing blade unit is capable, in particular, of engaging in a severing manner radially from the outside between the material roll 3 and the respective side cover 74 during use. Here, the material roll 3 preferably rotates about its centre axis 37. The severing blade unit is preferably used by the gantry robot 35 as a tool during use. In order to reach the two side covers 74, the gantry robot 35 is moved along the gantry carrier 36. The manipulator is actuated accordingly during the severing operation.

Figure 5:
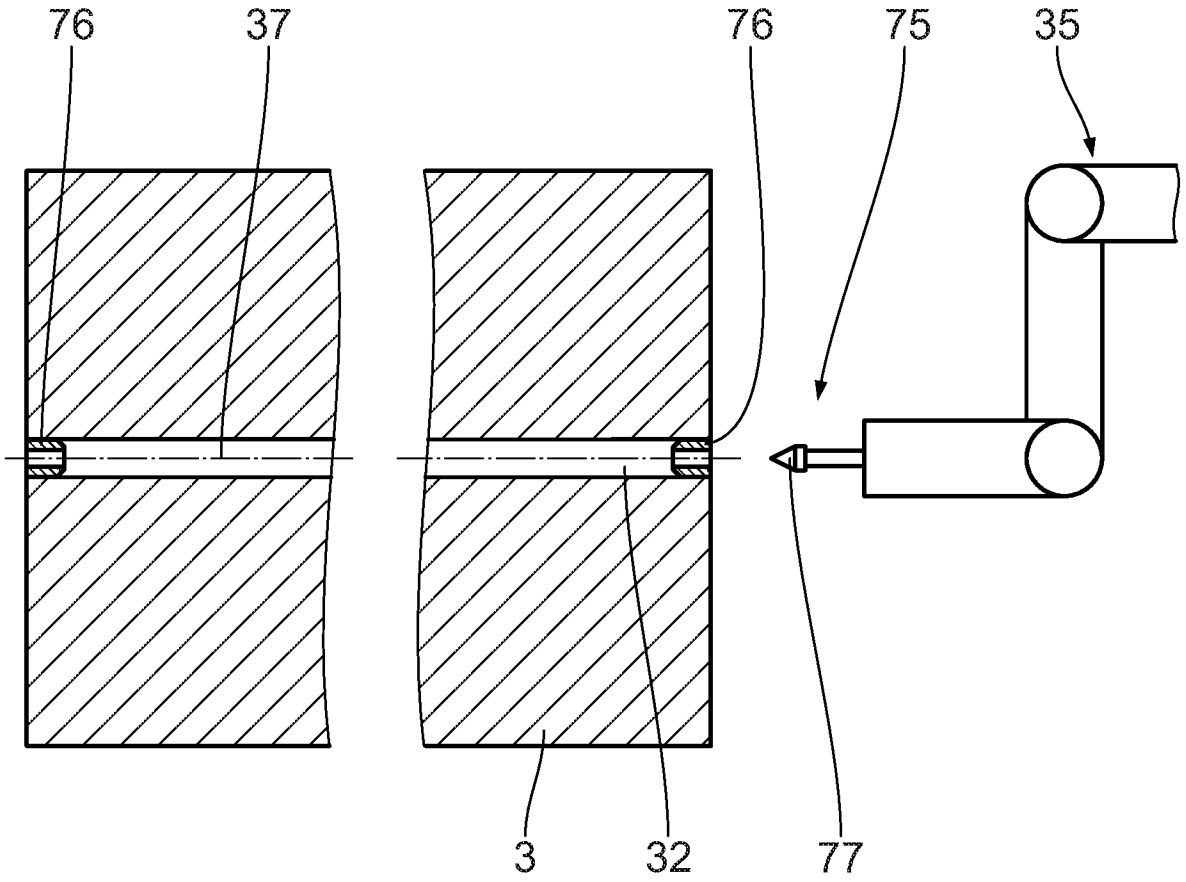
FIG. 5 shows a view of a simplified protective plug removal apparatus of the material roll preparation arrangement which is shown in FIGS. 2 and 3.
Figure 6:
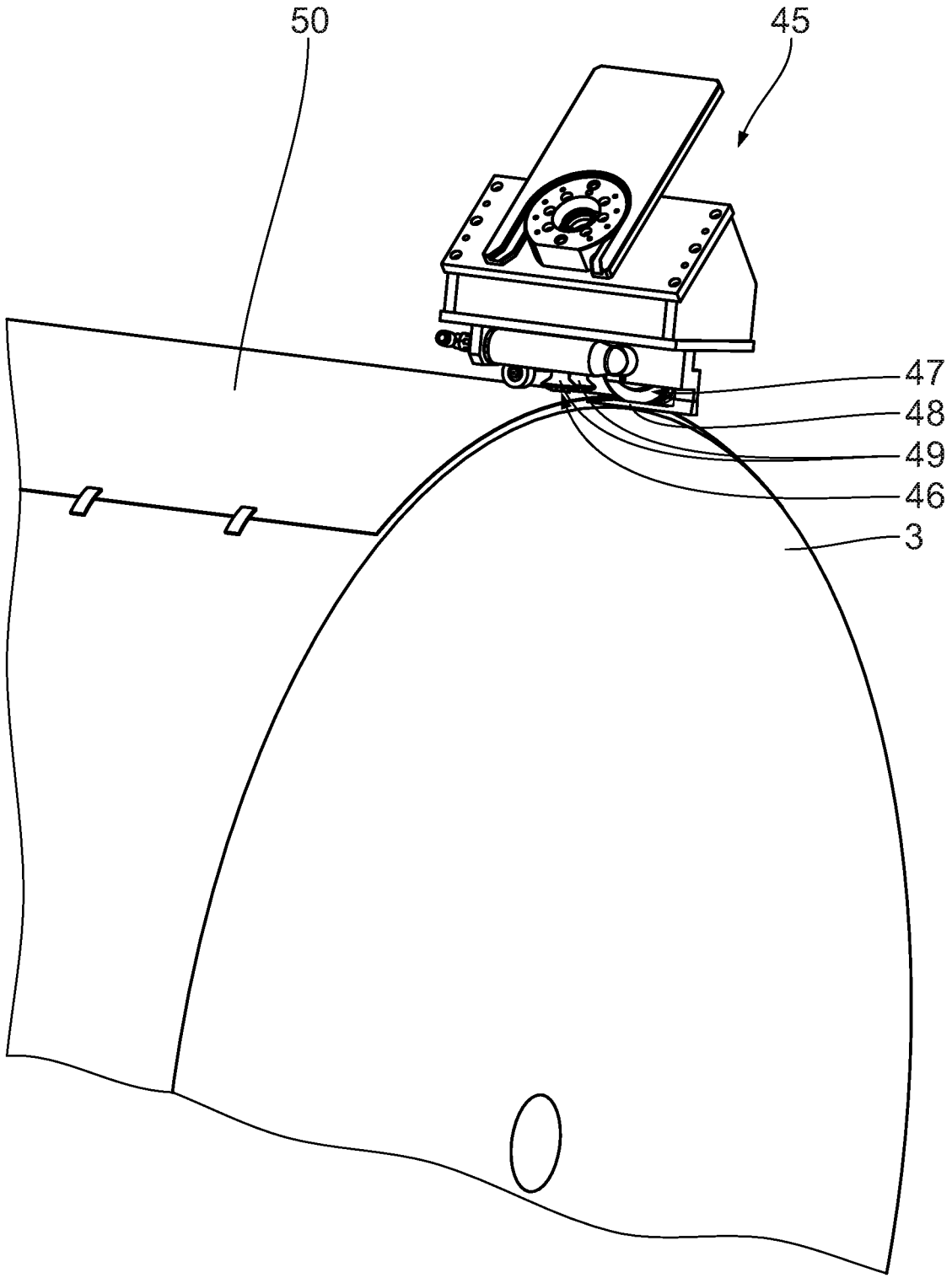
FIG. 6 shows a view of a simplified releasing device of a peeling apparatus of the material roll preparation arrangement which is shown in FIGS. 2 and 3 in the case of the severing of a material web section from a material web section which is arranged below it.

Furthermore, the material roll preparation arrangement 2 comprises a protective plug removal apparatus 75 which is capable of removing protective plugs 76 from the central carrying core 32 (FIG. 5). The protective plugs 76 are arranged in the two ends of the central carrying core 32. They are preferably rotationally symmetrical and sleeve-like. The external shape is in each case complementary with respect to the internal shape of the carrying core 32. The protective plugs 76 close the carrying core 32 partially. The protective plug removal apparatus 75 has a removal cone 77. During use, a tip of the removal cone 77 leads and is moved along the centre axis 37 of the material roll 3 to the respective protective plug 76. For the removal of the respective protective plug 76, the removal cone 77 is introduced, for example, axially from the outside into the protective plug 76, and is pulled axially out of the central carrying core 32 together with the protective plug 76. In the case of an introduction of the removal cone 77 into the protective plug 76, there is preferably a positively locking and/or non-positive connection between the two. The removal cone 77 can be driven rotationally, for example. As an alternative, for example, the protective plugs 76 can be destroyed by machining. The removal cone 77 is preferably used as a tool by the gantry robot 35. In order to reach the two protective plugs 76, the gantry robot 35 is moved along the gantry carrier 36. The manipulator is actuated accordingly in the case of the removal operation.

Moreover, the material roll preparation arrangement 2 has a peeling apparatus 44 (FIGS. 2, 3, 6 and 7A). The peeling apparatus 44 comprises a releasing device 45 with a lifting unit 46 and a severing unit 47, and a spacing mandrel 48.

The lifting unit 46 has suction bodies 49 with at least one suction channel which is flow-connected to a vacuum or negative pressure source (not shown).

The severing unit 47 is configured as an (in particular, rotationally drivable) cutting roll. During operation, a cutting axis of the cutting roll extends perpendicularly with respect to the centre axis 37 of the received material roll 3.

The spacing mandrel 48 extends adjacently with respect to, in particular below, the cutting roll. It runs perpendicularly with respect to the cutting axis in the direction of the suction bodies 49, and is capable of engaging under a free material web section 50 of the material web on the edge side. The free material web section 50 adjoins an outer circumference of the material web. One end of the material web is situated at the carrying core 32.

The releasing device 45 is capable of releasing or detaching the end-side material web section 50. During operation, the severing unit 47 severs an adhesive bond of the free material web section 50 from a material web section which is arranged below it. Via the suction bodies 49 and the spacing mandrel 48, the free end-side material web section 50 of the material roll 3 is lifted. Damage of the material web section which is arranged below it can thus be ruled out. The releasing device 45 is preferably used as a tool by the gantry robot 35. In order to reach the adhesive bonds at the two end sides, the gantry robot 35 is moved along the gantry carrier 36. The manipulator is actuated accordingly in the case of the removal operation. The material roll 3 is pivoted accordingly.

Moreover, the peeling apparatus 44 comprises a brush roll 51 which extends horizontally. It runs in parallel and adjacently with respect to the receiving device and/or the material roll 3 which is received there. The brush roll 51 extends over the entire length of the received material roll 3. It can preferably be driven rotationally and, during operation, is capable of acting on the material roll 3 on the circumferential side.

Above the brush roll 51, the peeling apparatus 44 has a deflection roll 52 which configures a discharging gap 53 with the brush roll 51. The deflection roll 52 extends in parallel along the brush roll 51.

By means of the rotating brush roll 51, the free material web section 50 can be lifted and can be introduced into the discharging gap 53. The free material web section 50 can be guided away from the carrying core 32. During use, the brush roll 51 ensures upward fanning of the free material web section 50 or lifting thereof.

A quality testing device 54 of the peeling apparatus 44 is arranged downstream of the discharging gap 53 in the discharging direction of the material web section 50, which quality testing device 54 is capable of testing an outer side 55 of the discharged material web section 50. The quality testing device 54 has a testing camera which is directed onto the outer side 55 of the material web section 50 and is capable of detecting damage in the outer side 55.

Furthermore, the peeling apparatus 44 has a discharging transport device 56 which is arranged downstream of the quality testing device 54. The discharging transport device 56 comprises a transport belt 58 which is guided around deflection rolls 57, and counter-rolls 59 which are assigned to the transport belt 58. Discharging nips are configured by way of the deflection rolls 57 and the transport belt 58, through which discharging nips the unwound material web section 50 is guided during operation.

A disposal container 60 is arranged downstream of the discharging transport device 56.

The quality testing device 54 tests the unwound material web section 50 for damage. It utilizes, for example, a contour measurement, an ultrasonic sensor, laser or camera technology such as by means of backlight technology or incident light. The material roll 3 is unrolled or unpeeled until a complete revolution thereof has been detected as being free from damage by the quality testing device 54.

The peeling apparatus 44 can be moved horizontally in its entirety, with the result that it can be adapted to different diameters of material rolls 3. The spacing of the peeling apparatus 44 from the receiving device is thus variable. An adjusting unit is favourably provided to this end.

Instead of the peeling apparatus 44, at least one vacuum unit, drawing roll rotating in the opposite direction, or brush can be used as an alternative.

A punching unit 61 with at least one rotationally drivable punching roll, preferably with at least one punching roll pair, is arranged upstream of the disposal container 60 in the discharging direction of the unwound material web section 50, which punching unit 61 is capable of cutting the unwound material web section 50 into longitudinal strips during operation (FIG. 3). During operation, the at least one rotating punching roll exerts a tensile force on the unwound material web section 50 in the direction of the disposal container 60, with the result that the unwound material web section 50 is held under stress and is thus protected against further damage. It is expedient if the punched strips are comminuted further, for example in a shredder, and are thus fed to the disposal container 60.

Figure 7A:
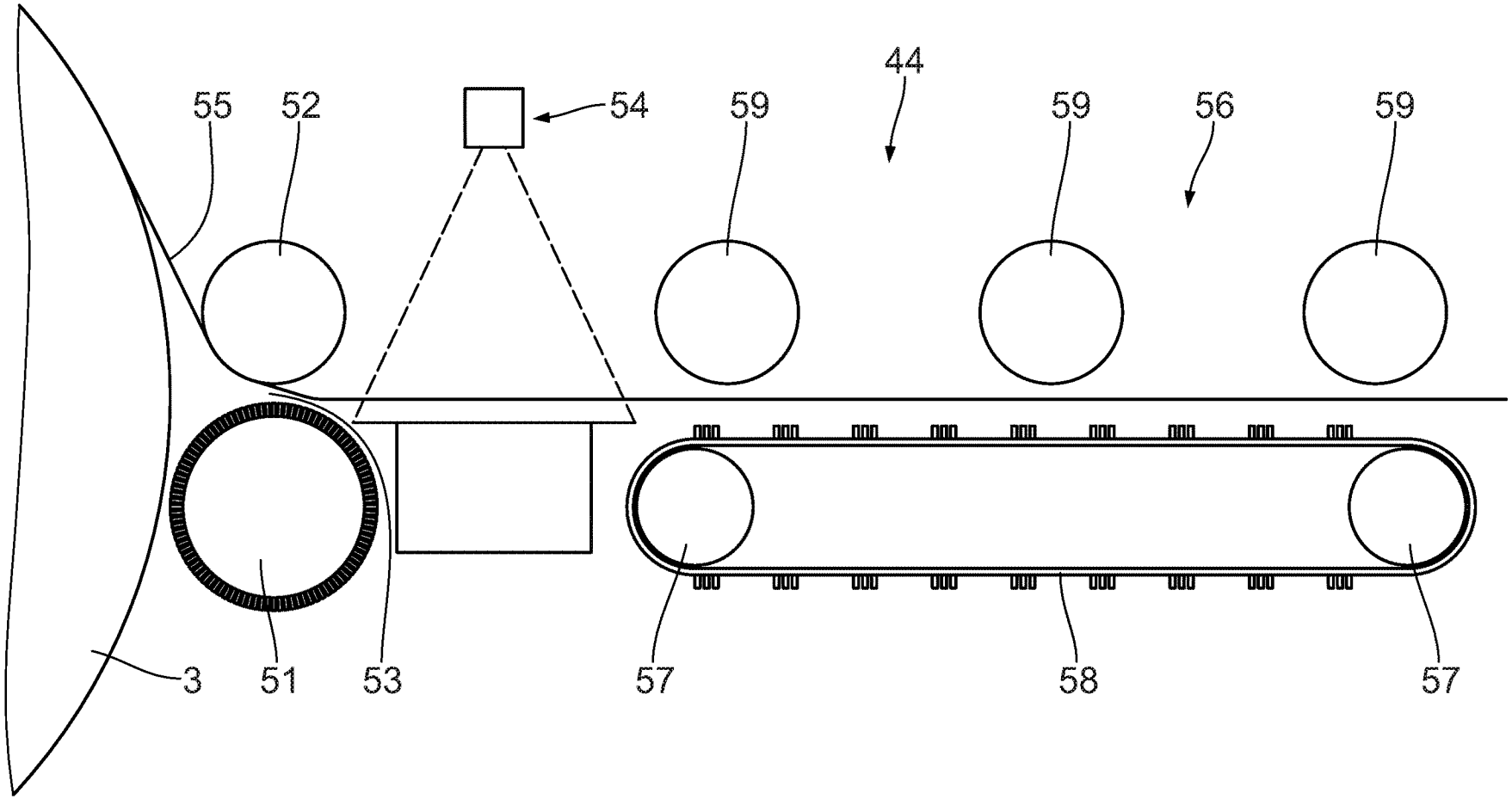
FIG. 7A shows a view of a simplified discharging transport device and a quality testing device of the peeling apparatus.
Figure 7B:
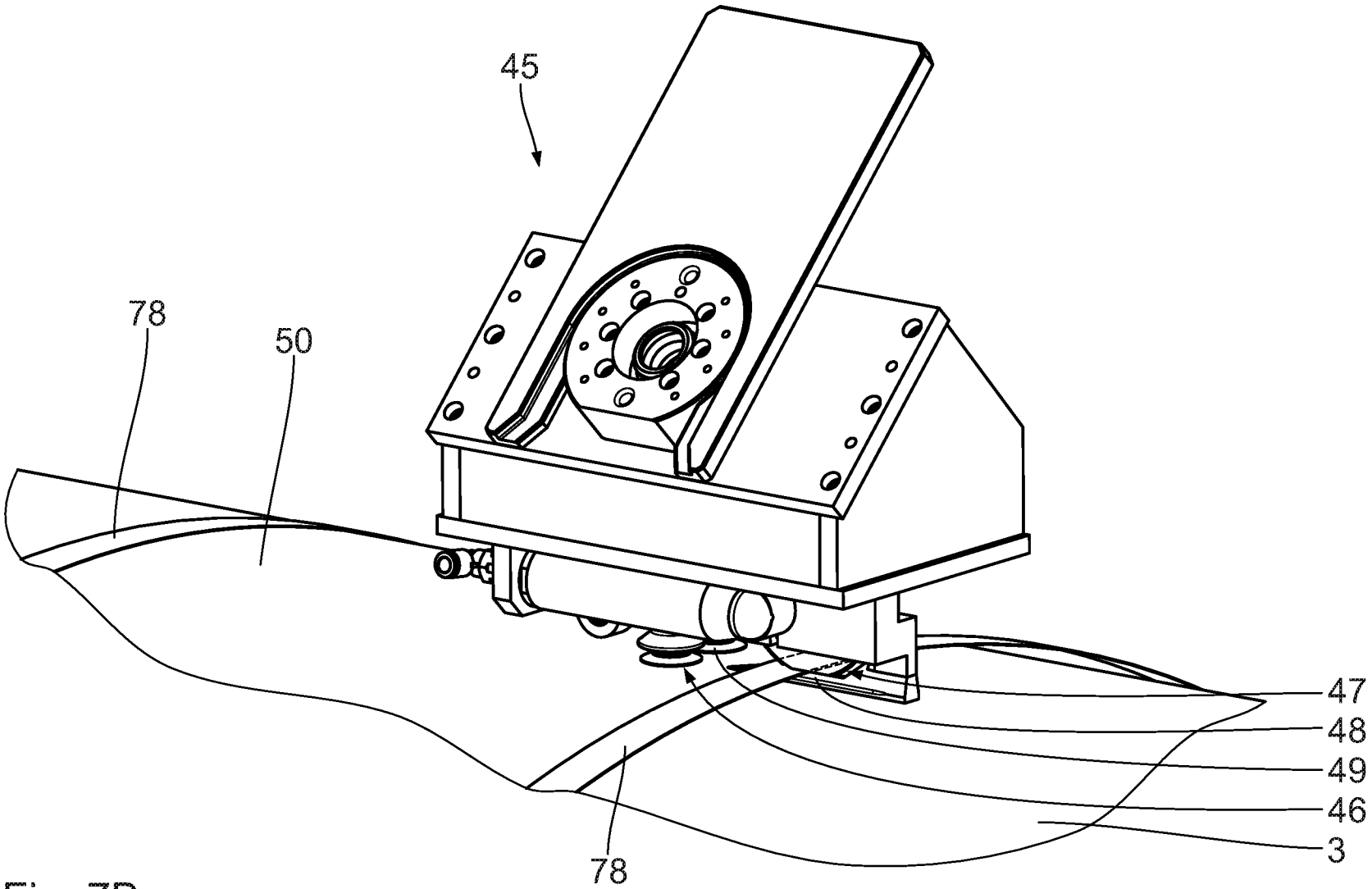
FIGS. 7B, 7C show views which correspond to FIG. 6 of a simplified strapping element removal apparatus of the material roll preparation arrangement which is shown in FIGS. 2 and 3 in the case of the removal of a strapping element which straps the material roll.
Figure 7C:
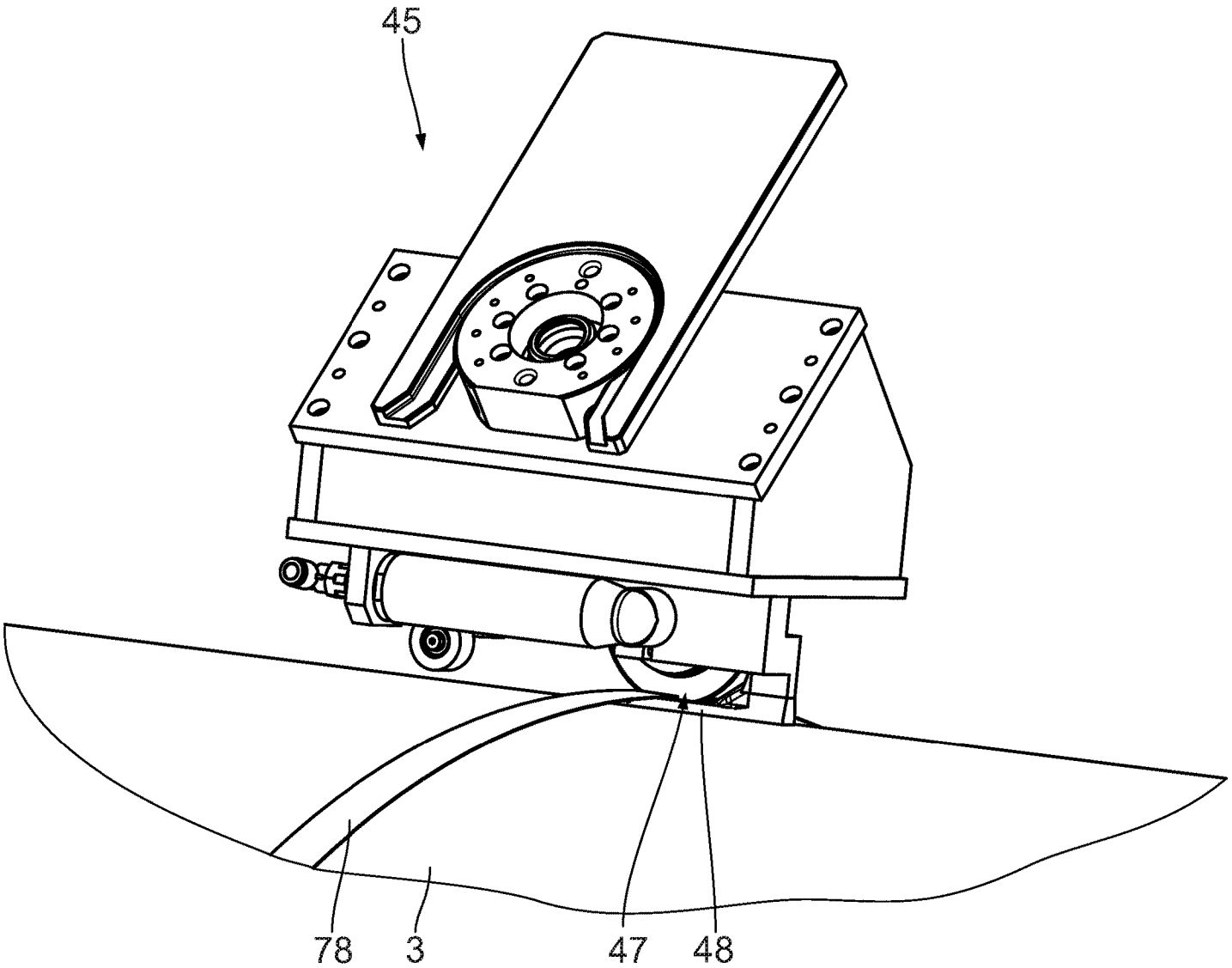

As an alternative or in addition, the releasing device 45 is capable of severing or removing strapping bands 78 which originally strap or run around the material roll 3 in a ring-like manner on the circumferential side, which leads to a release or detachment of the end-side material web section 50 (FIGS. 7B and 7C). It forms a strapping element removal apparatus. The strapping bands 78 are arranged spaced apart axially from one another and bear tightly on the outside against the material roll 3 or the end-side material web section 50. They hold the material roll 3 together.

During operation, the severing unit 47 severs the respective strapping band 78. Here, the spacing mandrel 48 engages under the respective strapping band 78. The severing unit 47 and the spacing mandrel 48 delimit a severing nip, in which the respective strapping band 78 is severed and is therefore removed from the material roll 3. Here, the suction bodies 49 are not used. To this end, the releasing device 45 is preferably used as a tool by the gantry robot 35. In order to reach the strapping bands 78, the gantry robot 35 is moved along the gantry carrier 36. The manipulator is actuated accordingly in the case of the removal operation.

It is expedient if the releasing device 45 has a strapping band detection device for the detection and location of the strapping bands 78. The strapping band detection device is favourably signal-connected to the gantry robot 35 for the corresponding actuation thereof.

Figure 11:
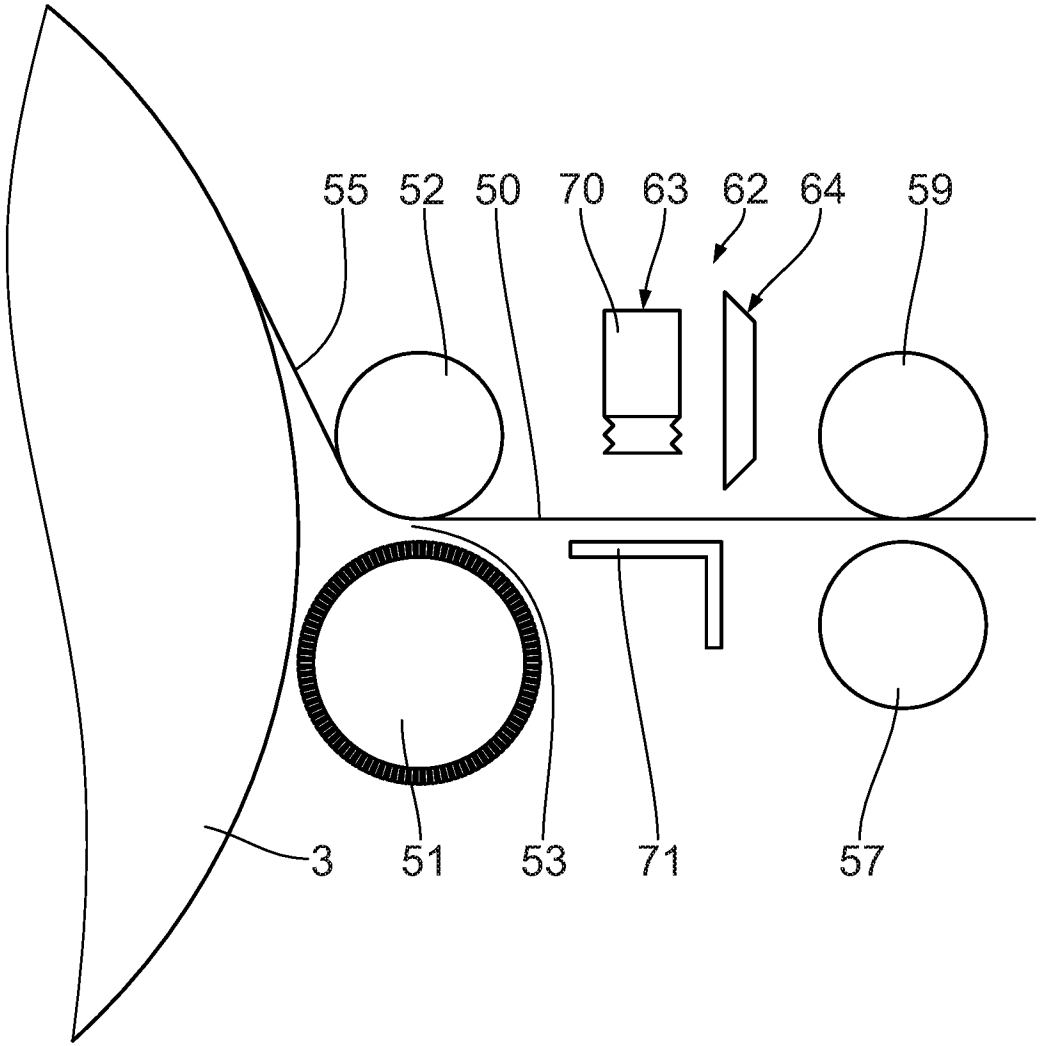
FIG. 11 shows a view of a simplified final contour production apparatus of the material roll preparation arrangement which is shown in FIGS. 2 and 3 for the production of the final contours according to FIGS. 8 to 10.
Figure 12:
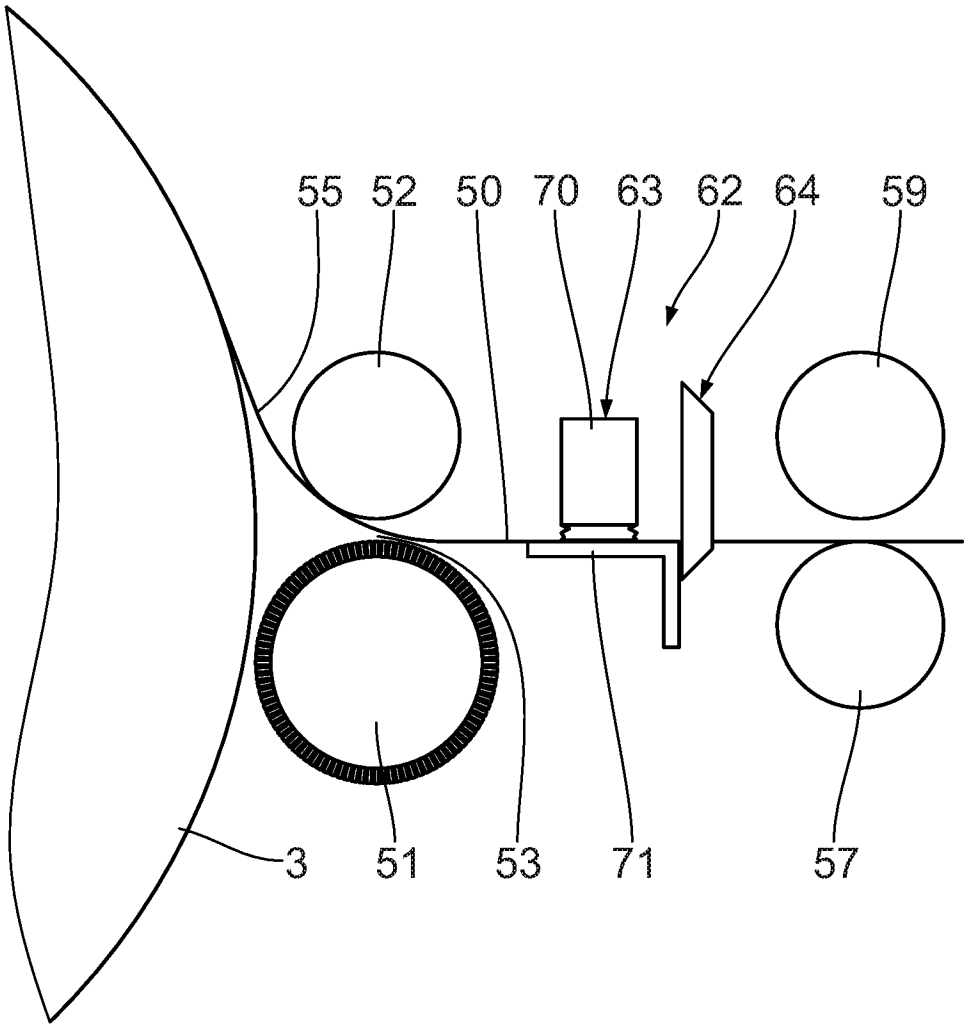
FIG. 12 shows a view which corresponds to FIG. 11, the final contour production apparatus being shown in an active state.

As FIGS. 11 and 12 show, the unwound material web section 50 is assigned a final contour production apparatus 62, in order to produce a defined final contour in the unwound material web section 50 which remains on the material roll 3.

The final contour production apparatus 62 has a clamping device 63 which is arranged downstream of the brush roll 51 and/or the deflection roll 52 in the discharging direction of the material web section 50. The clamping device 63 has a clamping body 70 which can be moved in a guided manner, in particular vertically, and a counter-body 71 which is assigned to the said clamping body 70. The clamping web section 50 can be fixed spatially (FIG. 12) between the clamping body 70 and the counter-body 71 in their clamping position. In the clamping position, the clamping body 70 and the counter-body 71 are arranged directly adjacently with respect to one another with the material web section 50 situated in between, and act in a clamping manner on the material web section 50 such that they lie opposite one another. In a non-clamping position, the clamping body 70 and the counter-body 71 are arranged spaced apart from one another and from the material web section 50. They do not then act on the material web section 50.

Furthermore, the final contour generation apparatus 62 has a cutting device 64 which can be moved in a guided manner and is arranged downstream of the clamping device 63. The cutting device 64 uses the counter-body 71 and, with the latter, configures a cutting nip in a cutting position.

In the clamped state of the material web section 50, the cutting device 64 is actuated (FIG. 12), in order to produce the desired final contour in the unwound material web section 50. In the case of the cutting, the cutting device 64 slides along on the counter-body 71. The final contour is situated in that trailing part of the unwound material web section 50 which remains on the material roll 3. The leading part of the unwound material web section 50 is disposed of.

Figure 8:
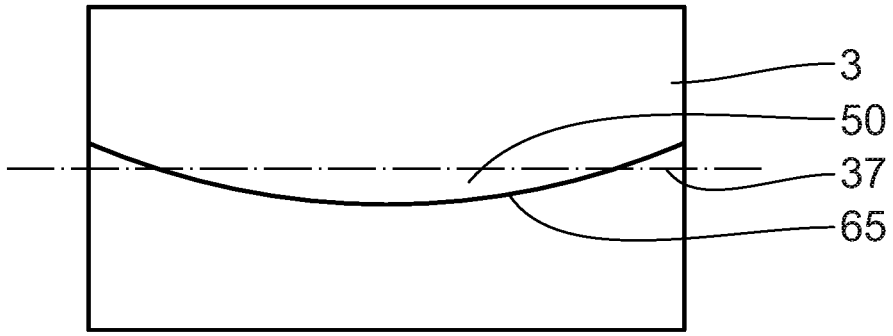
FIGS. 8 to 10 show possible final contours of the material web of the prepared material roll.

As FIG. 8 shows, the produced final contour 65 on the material web section 50 can be arcuate. A produced arc is favourably of symmetrical configuration in relation to the material web section 50 or the material web. A head region or tip region which is central in the transverse or width direction of the material web section 50 is leading in relation to the further processing of the material roll 3. The arcuate final contour 65 is suitable, in particular, for manual further processing of the material roll 3.

Figure 9:
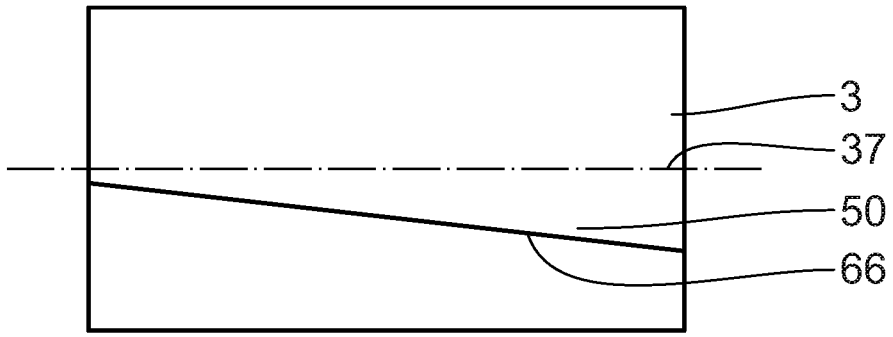

According to FIG. 9, the final contour 66 is formed by way of a cut which extends rectilinearly, but obliquely with respect to the longitudinal or conveying direction of the material web section 50. The oblique final contour 66 is suitable, in particular, for the manual further processing of the material roll 3.

Figure 10:
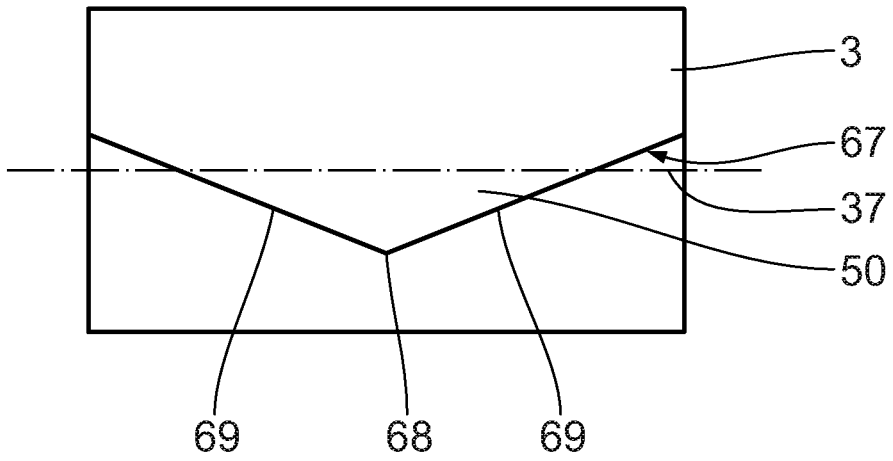

According to FIG. 10, the final contour 67 is formed by way of two rectilinear part sections 69 which form a tip 68. The tip 68 is favourably of symmetrical configuration in relation to the material web section 50 or the material web. It is leading in relation to the further processing of the material roll 3. The final contour 67 which has a central tip 68 is suitable, in particular, for automatic further processing of the material roll 3.

As an alternative, the final contours 65, 66, 67 are produced by means of the punching unit 61.

Figure 14:
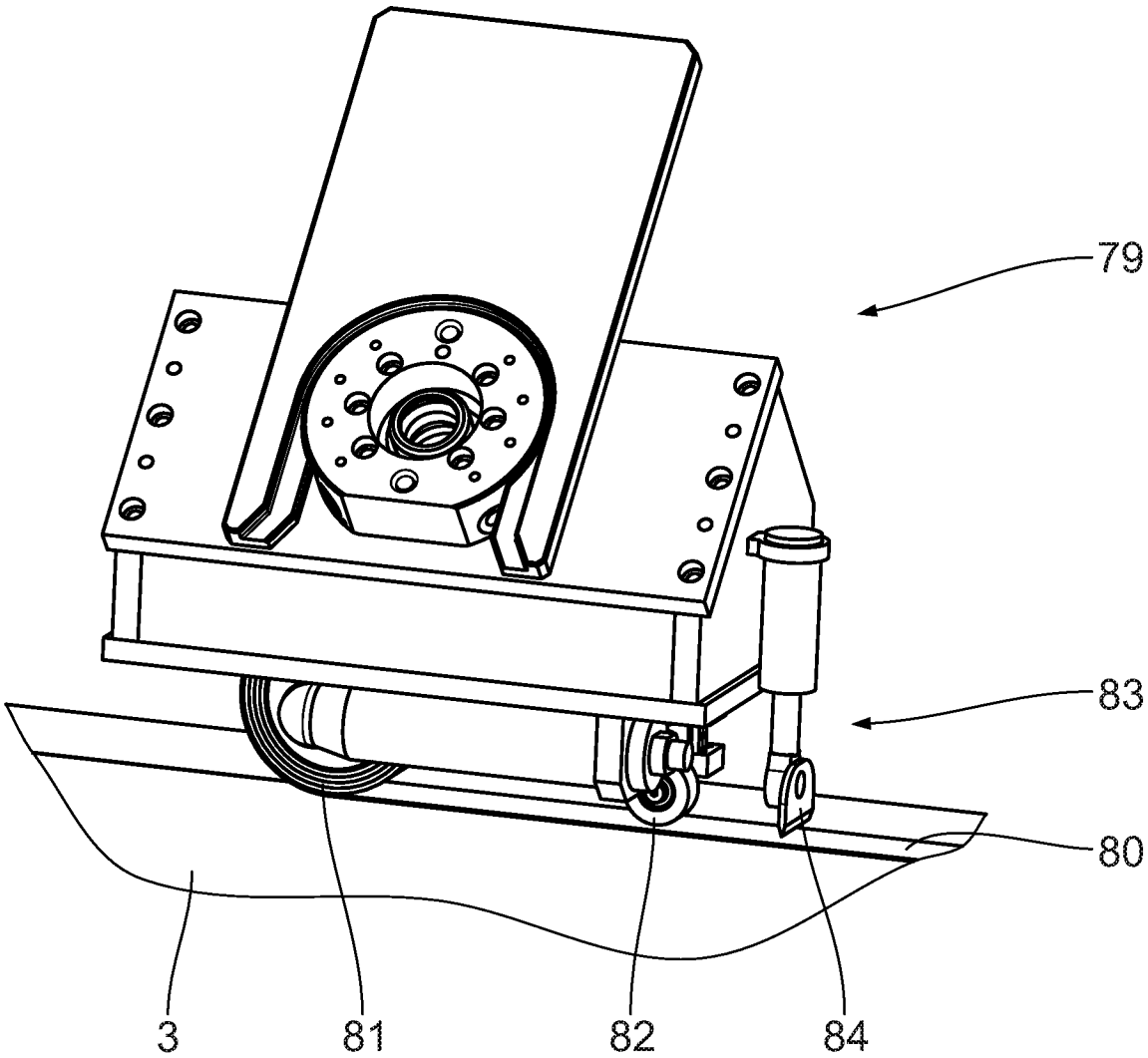
Figure 15:
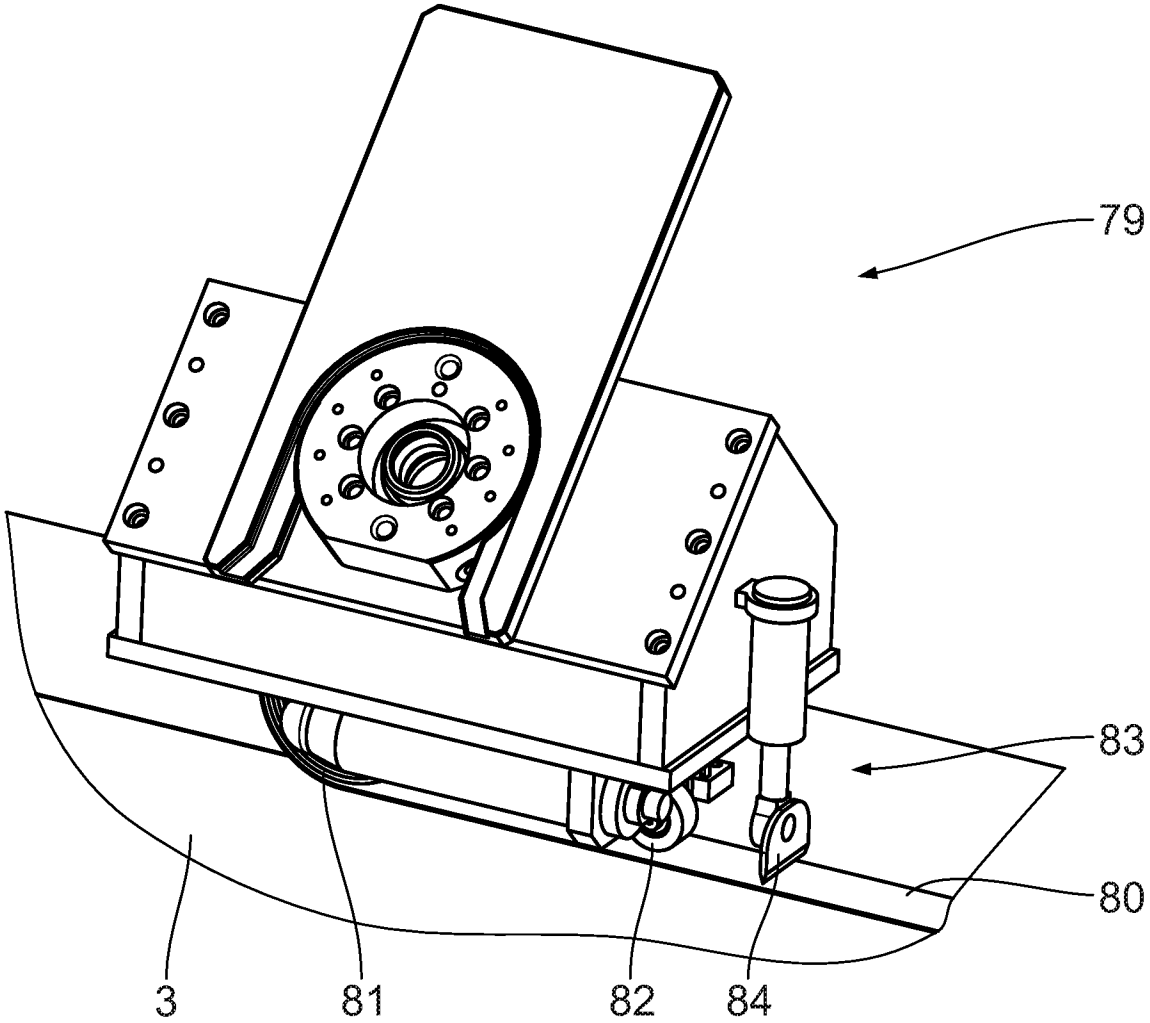

By way of a splicing tape attachment apparatus 79, a splicing tape 80 or piece thereof is attached in a sensor-controlled manner adjacently with respect to the produced final contour 65, 66, 67 to the material web section 50 which remains on the material roll 3 (FIGS. 14 and 15). In particular, the position, the angle and the contact pressure of the splicing tape 80 are monitored by sensor, which makes automatic further processing possible. Depending on the required winding direction, the splicing tape 80 is attached on the inner side or on the outer side to the material web section 50. The splicing tape 80 is arranged at a start or leading section of the material roll 3.

The splicing tape attachment apparatus 79 comprises a splicing tape supply roll 81, a splicing tape pressing roll 82 which is arranged downstream of the splicing tape supply roll 81 in the unwinding direction, and a severing tool 83 which is arranged downstream of the splicing tape pressing roll 82 in the unwinding direction.

The splicing tape supply roll 81 contains the splicing tape 80 in a wound-up form. It is mounted rotatably.

The splicing tape pressing roll 82 is likewise mounted rotatably. The splicing tape supply roll 81 and splicing tape pressing roll 82 have rotational axes which run parallel to one another. They preferably extend perpendicularly with respect to the centre axis of the material roll 3.

The severing tool 83 comprises a severing blade 84 which can be moved between a severing position and a rest position, in particular in a linear manner.

In the case of the attachment of the splicing tape 80 to the material web section 50, the splicing tape supply roll 81 is placed onto the material web section 50, with the result that an adhesive surface of the splicing tape 80 bears against the material web section 50. The splicing tape attachment apparatus 79 is then moved at least in regions along the final contour 65, 66, 67, the splicing tape supply roll 81 preferably rotating and unwinding the splicing tape 80. The splicing tape pressing roll 82 presses the splicing tape 80 which bears against the material web section 50 firmly onto the material web section 50. By way of the movement of the splicing tape attachment apparatus 79, the splicing tape pressing roll 82 rotates. In particular, the splicing tape pressing roll 82 bears against an outer severing cover of the splicing tape 80, which severing cover can be removed and originally covers a second outer adhesive surface of the splicing tape 80. In the rest position, the severing blade 84 is arranged spaced apart from the splicing tape 80. In the severing position, the severing blade 84 penetrates the splicing tape 80 with severing thereof when the splicing tape 80 is finally attached. By way of the splicing tape 80, a further finite material web can be connected to the finite material web of the material roll 3 in order to form an endless material web. The splicing tape attachment apparatus 79 is preferably used as a tool by the gantry robot 35. The gantry robot 35 is moved along the gantry carrier 36, preferably to a central region of the material roll 3, for the attachment of the splicing tape 80. The manipulator is actuated accordingly in the case of the attachment operation. The material roll 3 is pivoted accordingly.

Figure 13:
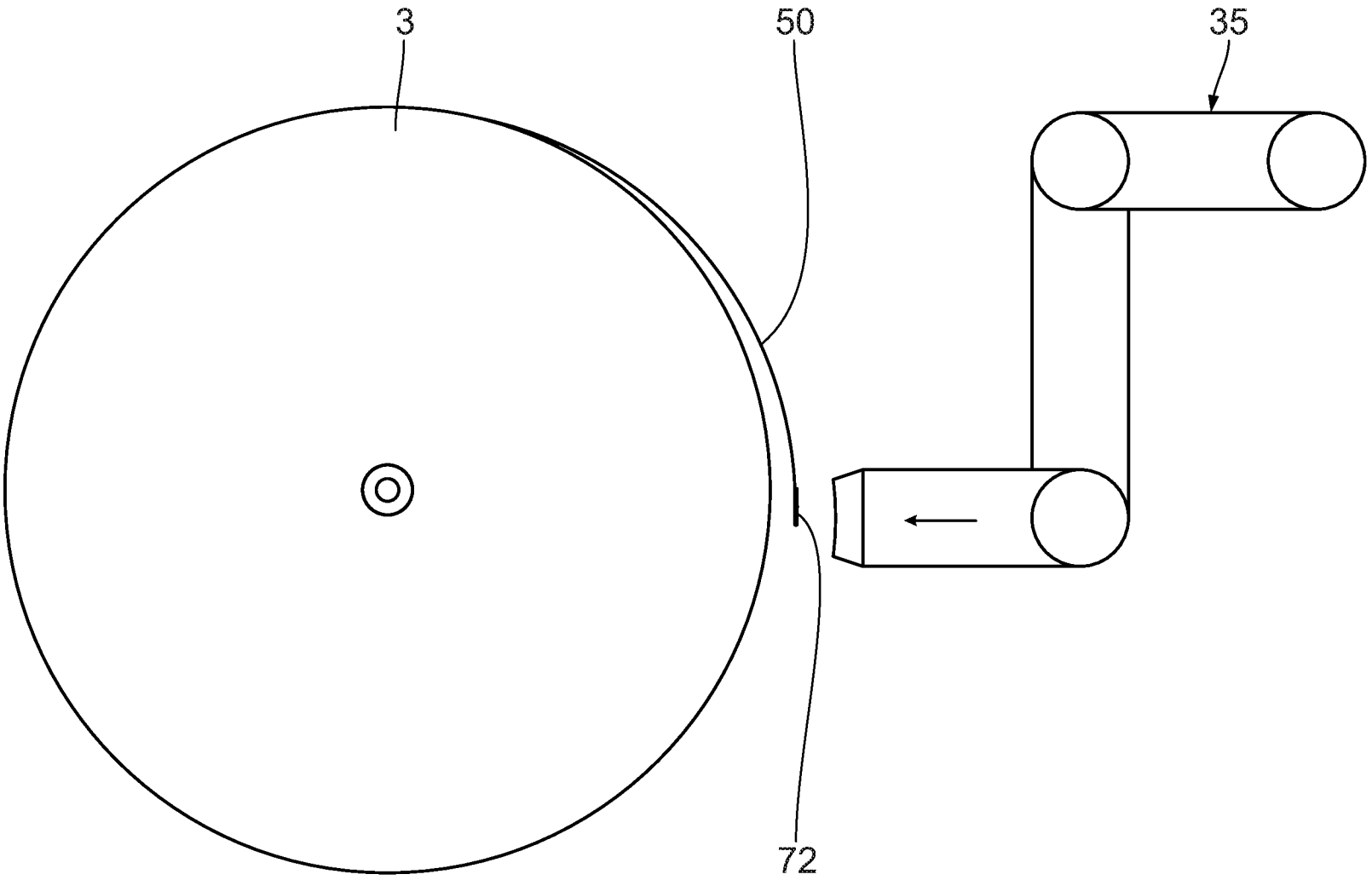
FIG. 13 shows a simplified view of a material web fixing apparatus of the material roll preparation arrangement which is shown in FIGS. 2 and 3, and FIG. 14, 15 show views of a simplified adhesive piece attachment apparatus of the material roll preparation arrangement which is shown in FIGS. 2 and 3.

Subsequently, the unwound material web section 50 is fixed on the actual material roll 3 by means of a fixing adhesive piece 72, with the result that unintentional lifting of the free end of the material roll 3 is prevented (FIG. 13). The fixing adhesive piece 72 bears in an adhesive manner against a material web section 50 which is arranged below it. The gantry robot 35 (shown in a simplified manner in FIG. 13) is used for the attachment of the fixing adhesive piece 72. To this end, it uses a corresponding fixing adhesive piece attachment tool. The gantry robot 35 is moved along the gantry carrier 36, for example to a central region of the material roll 3, for the attachment of the fixing adhesive piece 72. The manipulator is actuated accordingly in the case of the attachment operation. The material roll 3 is pivoted accordingly. The material roll 3 can thus be transported securely.

As an alternative, for example by way of the splicing tape attachment apparatus 79 which is shown in FIGS. 14 and 15 with the formation of a material web fixing apparatus, an adhesive tape 80 or at least one piece thereof is attached in a sensor-controlled manner adjacently with respect to the generated final contour 65, 66, 67 to the material web section 50 which remains on the material roll 3. In particular, the position, the angle and the contact pressure of the adhesive tape 80 are monitored by sensor, which makes automatic further processing possible. The adhesive tape 80 is arranged at a start or leading section of the material roll 3.

The adhesive tape attachment apparatus 79 comprises an adhesive tape supply roll 81, an adhesive tape pressing roll 82 which is arranged downstream of the adhesive tape supply roll 81 in the unwinding direction, and a severing tool 83 which is arranged downstream of the adhesive tape pressing roll 82 in the unwinding direction.

The adhesive tape supply roll 81 contains the adhesive tape 80 in a wound-up form. It is mounted rotatably.

The adhesive tape pressing roll 82 is likewise mounted rotatably. The adhesive tape supply roll 81 and adhesive tape pressing roll 82 have rotational axes which run parallel to one another. They preferably extend perpendicularly with respect to the centre axis of the material roll 3.

The severing tool 83 comprises a severing blade 84 which can be moved between a severing position and a rest position, in particular in a linear manner.

In the case of the attachment of the adhesive tape 80 to the material web section 50, the adhesive tape supply roll 81 is placed onto the material web section 50, with the result that an adhesive surface of the adhesive tape 80 bears against the material web section 50, and its adjacent end edge protrudes with an adhesive connection to the material web section which is arranged below it on the material roll 3. The adhesive tape attachment apparatus 79 is then moved at least in regions along the final contour 65, 66, 67, the adhesive tape supply roll 81 preferably rotating and unwinding the adhesive tape 80. The adhesive tape pressing roll 82 presses the adhesive tape 80 which bears against the material web section 50 firmly onto the material web section 50 and the material web section which is arranged below it. By way of the movement of the adhesive tape attachment apparatus 79, the adhesive tape pressing roll 82 rotates. In particular, the adhesive tape pressing roll 82 bears against a non-adhesive rear side of the adhesive tape 80. In the rest position, the severing blade 84 is arranged spaced apart from the adhesive tape 80. In the severing position, the severing blade 84 penetrates the adhesive tape 80 with severing thereof when the adhesive tape 80 is attached finally. By way of the adhesive tape 80, the free material web section 50 can be fixed on a material web section which lies below it, which prevents unintentional unwinding of the material web. The adhesive tape attachment apparatus 79 is preferably used as a tool by the gantry robot 35. The gantry robot 35 is moved along the gantry carrier 36, preferably to a central region of the material roll 3, for the attachment of the adhesive tape 80. The manipulator is actuated accordingly in the case of the attachment operation. The material roll 3 is pivoted accordingly.

The expressions "arranged upstream", "arranged downstream", "leading", "trailing" or the like which are used here relate, in particular, to the conveying direction of the associated web or of its section.

What is claimed is:

1. A material roll preparation arrangement, comprising:

a receiving apparatus for receiving a material roll to be prepared with a wound material web; and at least one material roll preparation apparatus which is assigned to the receiving apparatus for preparation of the material roll which is received in the receiving apparatus for further processing, the material roll preparation apparatus being configured as a peeling apparatus for removal of an end-side material web section of the material roll, the peeling apparatus comprising a lifting device for lifting the end-side material web section of the material web from a material web section which is arranged below it on the material roll, the peeling apparatus having a discharging transport device for discharge of the lifted material web section, the peeling apparatus having a quality testing device which is assigned to the discharging transport device for quality testing of the discharged material web section, the peeling apparatus comprising a peeling severing device for severing the discharged material web section, wherein a peeling computing device activates the peeling severing device if the quality testing device detects an undamaged material web section.

2. The material roll preparation arrangement according to claim 1, wherein the receiving apparatus comprises a rotational device for rotationally driving the received material roll about its center axis.

3. The material roll preparation arrangement according to claim 1, wherein the receiving apparatus holds the material roll to be prepared such that it is spaced apart from a floor.

4. The material roll preparation arrangement according to claim 1, wherein the receiving apparatus holds the material roll to be prepared such that it is arranged horizontally.

5. The material roll preparation arrangement according to claim 1, further comprising an aligning device for aligning a receiving device of the receiving apparatus and the material roll which is received in the receiving apparatus with respect to one another.

6. The material roll preparation arrangement according to claim 1, wherein the receiving apparatus is configured to receive the material roll to be prepared, in an automated manner.

7. The material roll preparation arrangement according to claim 1, wherein the receiving apparatus is configured to receive the material roll to be prepared in a completely automated manner.

8. The material roll preparation arrangement according to claim 1, wherein at least one material roll preparation apparatus is capable of operating in an automated manner.

9. The material roll preparation arrangement according to claim 1, wherein at least one material roll preparation apparatus is capable of operating in a completely automated manner.

10. The material roll preparation arrangement according to claim 1, further comprising a material roll detection apparatus for detection of a material web section of the material web of the material roll which is received in the receiving apparatus.

11. The material roll preparation arrangement according to claim 1, wherein the material roll preparation apparatus is configured as a strapping element removal apparatus for removal of at least one strapping element which straps the material roll.

12. The material roll preparation arrangement according to claim 11, wherein the strapping element removal apparatus comprises a strapping element detection device for detection of the at least one strapping element.

13. The material roll preparation arrangement according to claim 11, wherein the strapping element removal apparatus has a strapping element cutting unit for cutting the at least one strapping element.

14. The material roll preparation arrangement according to claim 1, wherein the material roll preparation apparatus is configured as a side cover removal apparatus for removal of side covers which cover the material roll on end side.

15. The material roll preparation arrangement according to claim 14, wherein the side cover removal apparatus has a side cover severing blade unit for removal of the side covers.

16. The material roll preparation arrangement according to claim 14, wherein the side cover removal apparatus has a side cover severing blade unit for removal of the side covers in case of a rotating material roll.

17. The material roll preparation arrangement according to claim 1, wherein the material roll preparation apparatus is configured as a protective plug removal apparatus for removal of protective plugs which are arranged in a central carrying core of the material roll on end side.

18. The material roll preparation arrangement according to claim 1, wherein the peeling apparatus comprises a peeling severing device for severing the lifted material web section.

19. The material roll preparation arrangement according to claim 1, wherein the material roll preparation apparatus is configured as a final contour production apparatus for production of a final contour in the material web, which final contour is usable as in the further processing.

20. The material roll preparation arrangement according to claim 19, wherein the final contour production apparatus has one of a final contour cutting device and a final contour punching device.

21. The material roll preparation arrangement according to claim 1, wherein the material roll preparation apparatus is configured as a splicing piece attachment apparatus for attachment of at least one splicing piece onto the material web for splicing of another material web.

22. The material roll preparation arrangement according to claim 1, wherein the material roll preparation apparatus is configured as a material web fixing apparatus for fixing an end-side material web section.

23. The material roll preparation arrangement according to claim 1, further comprising a plurality of material roll preparation apparatuses which are formed by way of at least one robot.

24. The material roll preparation arrangement according to claim 23, wherein the robot uses interchangeable tools.

25. A material roll preparation arrangement, comprising:

a receiving apparatus for receiving a material roll to be prepared with a wound material web; and a plurality of material roll preparation apparatuses which are assigned to the receiving apparatus for preparation of the material roll which is received in the receiving apparatus for further processing and are formed by way of at least one robot, wherein the robot uses interchangeable tools.

* * * * *